US009963883B1

(12) United States Patent
Franco

(10) Patent No.: US 9,963,883 B1
(45) Date of Patent: May 8, 2018

(54) OPERABLE RAMP

(71) Applicant: George Franco, Modesto, CA (US)

(72) Inventor: George Franco, Modesto, CA (US)

(73) Assignee: Lift-U, Division of Hogan Mfg., Inc., Escalon, CA (US)

( * ) Notice: Subject to any disclaimer, the term of this patent is extended or adjusted under 35 U.S.C. 154(b) by 0 days. days.

(21) Appl. No.: 15/693,323

(22) Filed: Aug. 31, 2017

Related U.S. Application Data

(63) Continuation-in-part of application No. 15/616,726, filed on Jun. 7, 2017, which is a continuation of application No. 15/424,687, filed on Feb. 3, 2017, now Pat. No. 9,708,815.

(51) Int. Cl.
*E04F 11/06* (2006.01)
*E04F 11/00* (2006.01)

(52) U.S. Cl.
CPC ..... *E04F 11/002* (2013.01); *E04F 11/06* (2013.01); *E04F 2011/005* (2013.01); *E04F 2011/007* (2013.01)

(58) Field of Classification Search
CPC ... E04F 11/002; E04F 11/06; E04F 2011/005; E04F 2011/007
USPC ..... 14/71.3; 187/200
See application file for complete search history.

(56) References Cited

U.S. PATENT DOCUMENTS 4,559,659 A * 12/1985 Hunter, Jr. ..... A61G 3/061 105/436
5,454,196 A * 10/1995 Gaines ..... E04F 11/002 14/69.5
5,947,231 A * 9/1999 Raab ..... A61G 3/063 187/200
6,484,344 B1 * 11/2002 Cooper ..... A61G 3/061 14/71.1
7,913,343 B1 3/2011 Cohn
8,161,589 B1 * 4/2012 Heffernan ..... B65G 69/2829 14/71.3
8,631,529 B1 * 1/2014 Johnson ..... B66B 9/0869 14/71.3
8,739,342 B1 6/2014 Johnson et al.
8,782,840 B2 7/2014 Saucier et al.
8,813,290 B1 * 8/2014 Morris ..... E04F 11/002 14/71.3
8,832,893 B1 * 9/2014 Morris ..... B66B 9/08 14/71.3
8,869,333 B2 10/2014 Johnson et al.
(Continued)

*Primary Examiner* — Gary S Hartmann
(74) *Attorney, Agent, or Firm* — Christensen O'Connor Johnson Kindness PLLC

(57) ABSTRACT

An operable ramp is moveable between stowed and deployed positions. In the deployed position, the ramp provides a sloped transition surface that extends from a lower surface of an architectural setting to an upper surface of the architectural setting. The operable ramp includes a ramp panel and a housing. The height of an upper surface of the housing is selectively adjustable. The operable ramp further includes a drive assembly that is at least partially disposed within the housing. The drive assembly has a drive linkage coupled to a first end of the ramp panel to move the operable ramp between the stowed and deployed positions. The drive linkage raises the first end of the ramp panel to a first elevation when the upper surface of the housing is at a first height and to a second elevation when the upper surface of the housing is at a second height.

20 Claims, 32 Drawing Sheets

(56) References Cited

U.S. PATENT DOCUMENTS

| | | | | |
|---|---|---|---|---|
| 8,887,337 | B1 * | 11/2014 | Morris | E04F 11/002 14/71.1 |
| 8,918,939 | B1 * | 12/2014 | Morris | E04F 11/002 14/71.1 |
| 8,925,131 | B1 | 1/2015 | Morris | |
| 8,943,631 | B1 | 2/2015 | Morris et al. | |
| 9,045,908 | B1 | 6/2015 | Morris et al. | |
| 9,580,910 | B1 * | 2/2017 | Morris | E04F 11/002 |
| 9,587,404 | B1 * | 3/2017 | Franco | E04F 11/002 |
| 9,597,240 | B2 * | 3/2017 | Hermanson | A61G 3/061 |
| 9,708,815 | B1 * | 7/2017 | Morris | E04F 11/002 |
| 9,719,261 | B2 * | 8/2017 | Belman | E04F 11/002 |
| 2003/0051299 | A1 * | 3/2003 | Bearint | A61G 3/061 14/69.5 |
| 2016/0273226 | A1 * | 9/2016 | Belman | E04F 11/002 |

* cited by examiner

OPERABLE RAMP

CROSS-REFERENCES TO RELATED APPLICATIONS

This application is a continuation-in-part of U.S. application Ser. No. 15/616,726, filed Jun. 7, 2017, which is a continuation of U.S. application Ser. No. 15/424,687, filed Feb. 3, 2017, and issued as U.S. Pat. No. 9,708,815, on Jul. 18, 2017, the entire disclosures of which are incorporated by reference herein.

BACKGROUND

The Americans with Disabilities Act (ADA) requires the removal of physical obstacles to those who are physically challenged. The stated objective of this legislation has increased public awareness and concern over the requirements of the physically challenged. Consequentially, there has been more emphasis on providing systems that enable physically challenged people to access buildings and other architectural structures that have a step at the point of ingress or egress. Such systems can also be utilized in building interiors to provide improved access to inside architectural features, such as raised landings.

Installing a fixed ramp is a common way to provide the physically challenged with access to a building with one or more steps at the entrance, i.e., between a lower surface and an upper surface. Fixed ramps take up a large amount of space and often detract from the aesthetic qualities of the building. Fold out ramps, similar to those used in vehicles can be utilized, but deployment often requires a large area into which the ramp deploys. Other ramps simply raise or lower one end or to reciprocate between a "step" configuration and a "ramp" configuration. Such ramps, however, typically require a pit formed in the upper or lower surface to integrate the ramp with the step of the architectural setting. That is, the ramp is recessed into the architectural setting. In addition, ramps are often installed in architectural settings in which the step height varies, and ramp components and installations must be modified to suit a particular environment.

Accordingly, there is a need for a ramp that provides access to a building with a step at the entrance or within the interior, while minimizing the space required by the ramp. There is also a need for a ramp that allows for installation without requiring undue alterations of the architectural setting and that can be easily adapted for installation in different architectural environments.

SUMMARY

A first representative embodiment of an operable ramp according to the present disclosure is moveable between a stowed position and a deployed position. In the deployed position, the ramp provides a sloped transition surface that extends from a lower surface of an architectural setting to an upper surface of the architectural setting. The operable ramp includes a ramp panel and a housing. The height of an upper surface of the housing is selectively adjustable. The operable ramp further includes a drive assembly that is at least partially disposed within the housing. The drive assembly has a drive linkage coupled to a first end of the ramp panel to move the operable ramp between the stowed and deployed positions. The drive linkage raises the first end of the ramp panel to a first elevation when the upper surface of the housing is at a first height and to a second elevation when the upper surface of the housing is at a second height.

A second representative embodiment of an operable ramp according to the present disclosure is moveable between a stowed position and a deployed position. In the deployed position, the operable ramp provides a sloped transition surface that extends from a lower surface of an architectural setting to an upper surface of the architectural setting. The operable ramp includes a ramp panel and a housing. The housing is configured so that an upper surface of the housing is selectively positionable relative to a base of the housing. The operable ramp further includes a drive assembly that is at least partially disposed within the housing. The drive assembly includes a four-bar linkage operatively coupled to the ramp panel and selectively actuated to reciprocate the ramp panel between a stowed position and a deployed position.

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION

Figure 1:
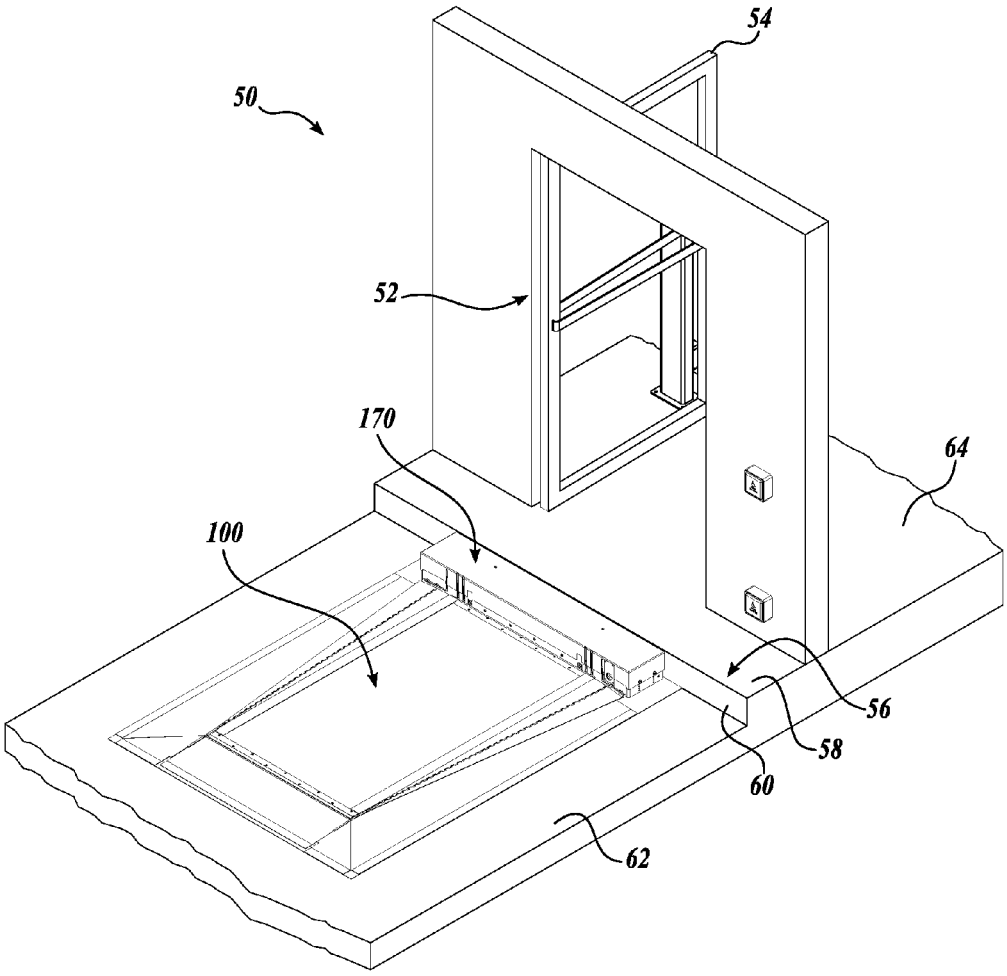
FIG. 1 shows a front isometric view of a first representative embodiment of an operable ramp installed at an entrance to a building, wherein the operable ramp is in a stowed position.
Figure 2:
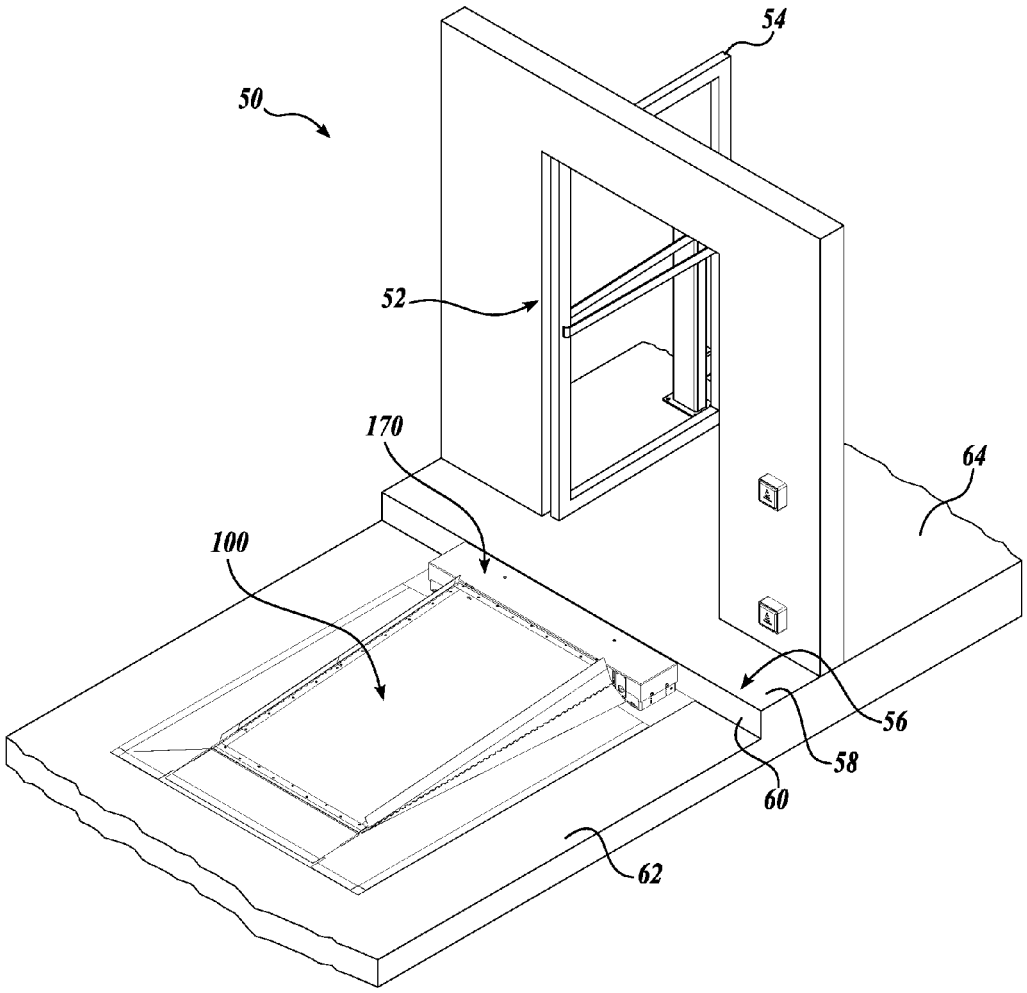
FIG. 2 shows a front isometric view of the operable ramp of FIG. 1 installed at an entrance to a building, wherein the operable ramp is in a deployed position.
Figure 3:
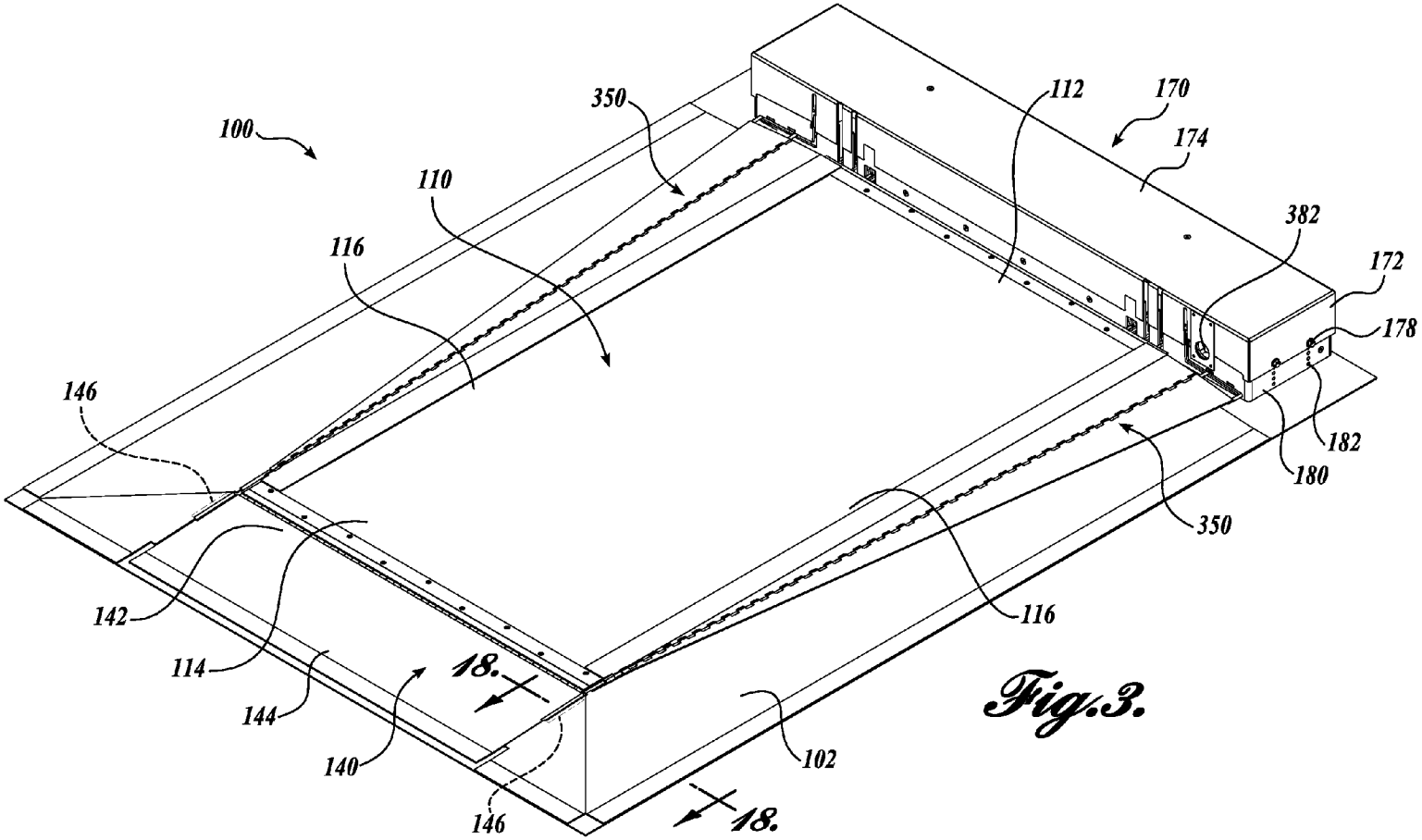
FIG. 3 shows a front isometric view of the operable ramp of FIG. 1 in the stowed position.
Figure 4:
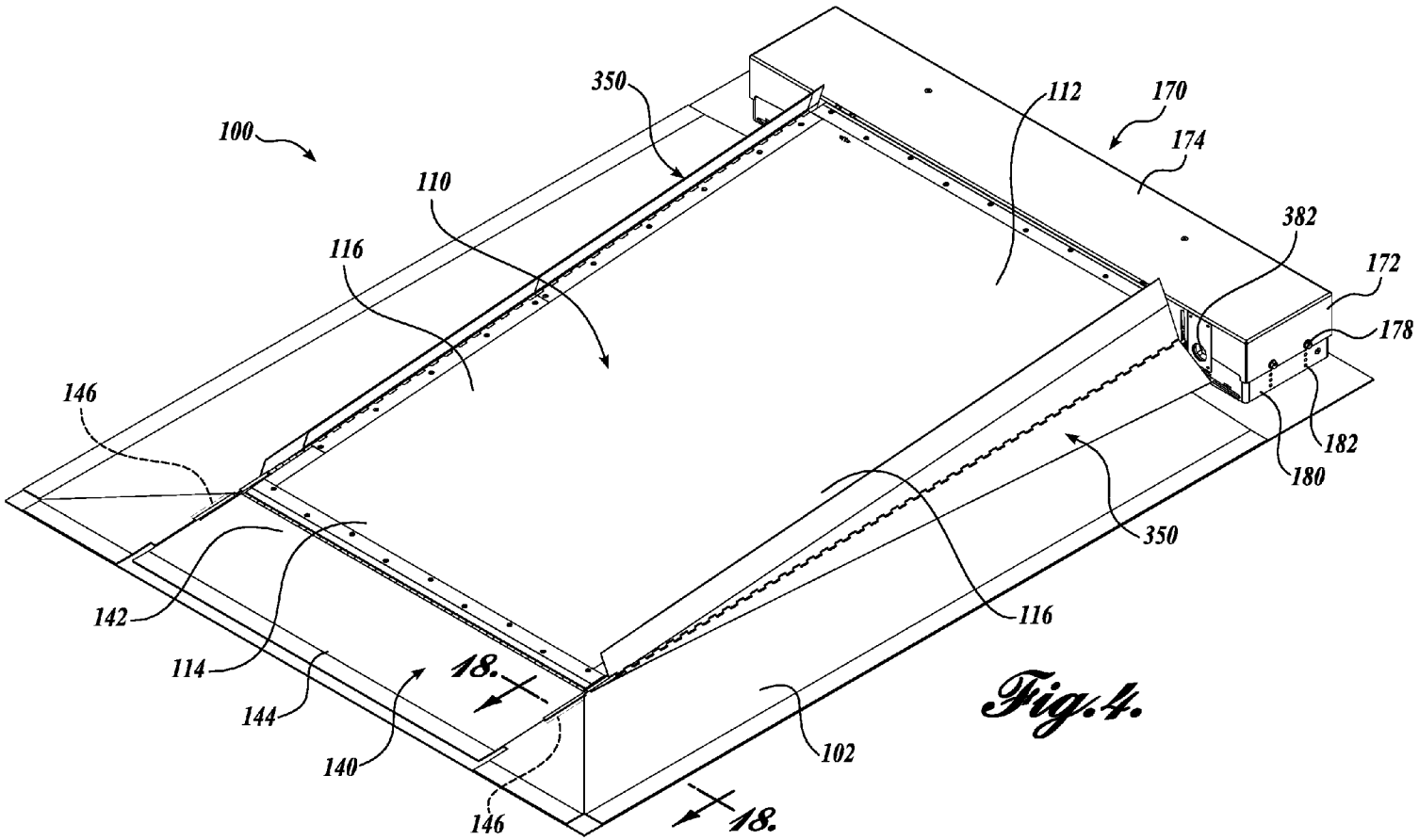
FIG. 4 shows a front isometric view of the operable ramp of FIG. 3 in the deployed position.

Referring now to FIGS. 1-18 a first representative embodiment of an operable ramp 100 according to the present disclosure will be described. FIGURES land 2 show the operable ramp 100 in a stowed position and a deployed position, respectively, while installed at the entrance 52 of a building 50. FIGS. 3 and 4 show the same embodiment of an operable ramp 100 stowed and deployed, respectively, in isolation, i.e., not installed. Referring to FIGS. 1 and 2, the entrance 52 includes a door 54 with a step 56 positioned outside of the door. The step includes a tread portion 58 and a riser portion 60. The tread portion 58 of the step 56 is level with the floor of the building 50 so that a person walking into the building uses the step to step up from a lower first surface 62 outside the building to a higher second surface 64 inside the building. It will be appreciated that the illustrated installation of the operable ramp 100 is exemplary only and should not be considered limiting. In this regard, the operable ramp 100 can be installed in any number of architectural settings having a step that would present an obstacle for a disabled person.

The operable ramp 100 includes a housing 170 that contains a drive assembly 200 located proximate to the riser portion 60. As shown in FIGS. 1 and 2, the housing 170 is generally rectangular and is sized and configured to be positioned against the riser portion 60 of the step 56 so that an upper surface 174 of the housing 170 is generally coplanar with the second surface 64. As a result, the housing 170 acts as an extension of the second surface 64, and thus, the step 56.

First Ramp Panel

Figure 5:
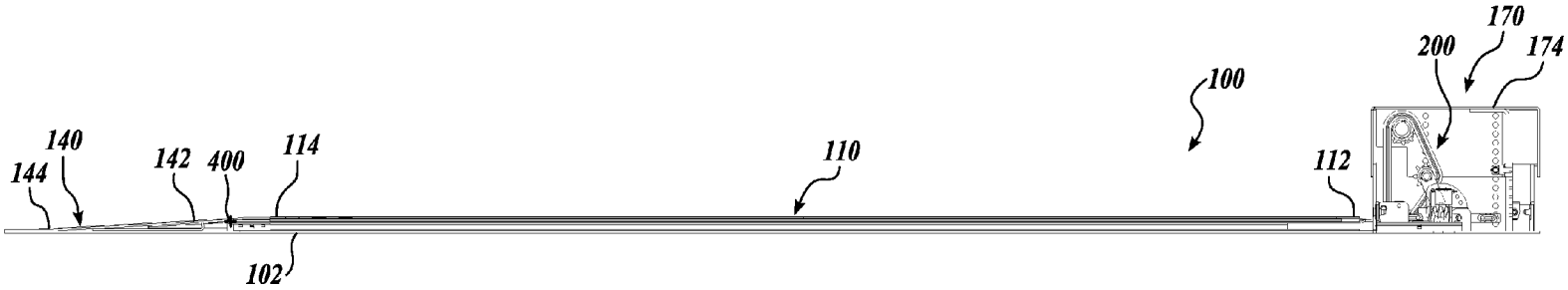
FIG. 5 shows a cutaway side view of the operable ramp of FIG. 3 in the stowed position.
Figure 6:
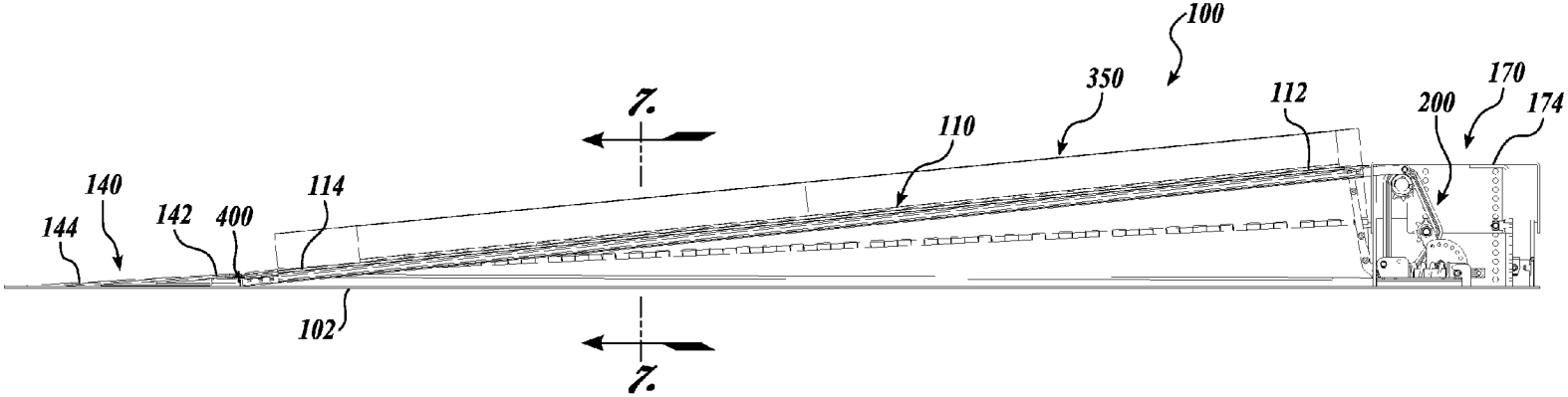
FIG. 6 shows a cutaway side view of the operable ramp of FIG. 3 in the deployed position.
Figure 7:
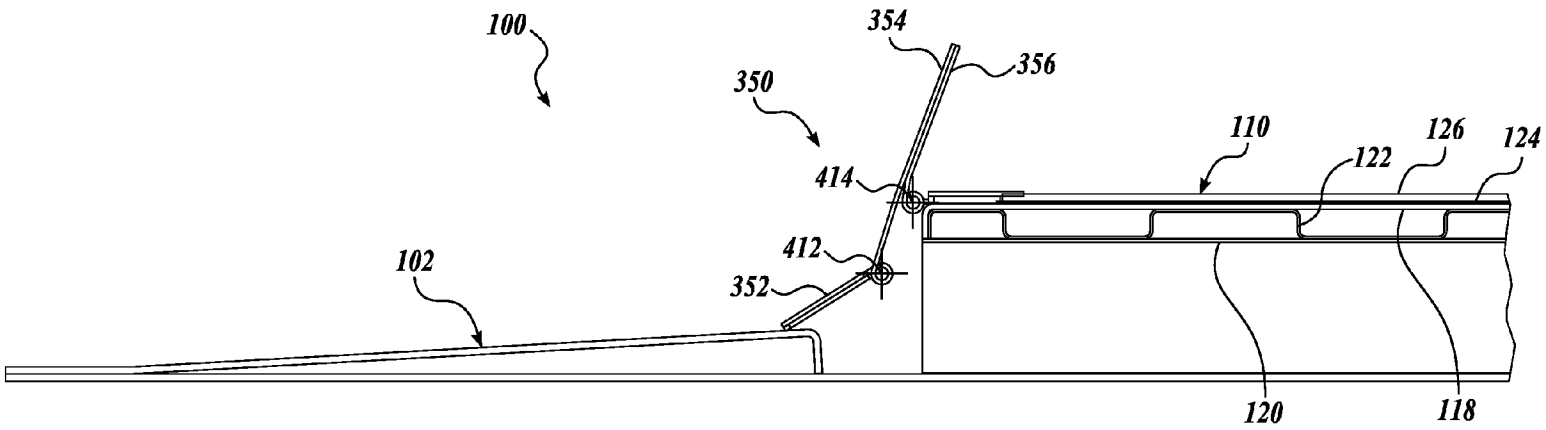
FIG. 7 shows a partial cutaway rear end view of the operable ramp of FIG. 6 in the deployed position.

Referring to FIGS. 5-7, a first ramp panel 110 has a first end 112 coupled to the drive assembly 200 that selectively reciprocates the first end between a lowered (stowed) position and a raised (deployed) position. The first ramp panel 110 is constructed from well-known materials to have suitable strength and durability. As best shown in FIG. 7, the first ramp panel 110 of the disclosed embodiment includes a corrugated sheet metal layer 122 disposed between an upper plate 118 and a lower plate 120. A suitable tread surface 126 is disposed on top of the upper plate 118 to provide a replaceable slip-resistant surface. The layers of the panel are secured together using welds, adhesive, mechanical fasteners, or any other suitable methods or combinations of suitable methods.

Positioned between the tread surface 126 and the upper plate 118 is a thin membrane pressure sensor 124 configured to sense the presence of a passenger on the operable ramp 100. The sensor 124 is operably coupled to a controller 232, which prevents operation of the operable ramp 100 when the sensor 124 sends a signal to the controller indicating that a passenger is present on the operable ramp. It will be appreciated that other sensor types and configurations may be utilized, and that the location of such sensors is not limited to the operable ramp 100, itself. In one contemplated embodiment, an optical sensor is positioned above or proximate to the operable ramp 100. These and other configurations to sense the presence of a passenger on the operable ramp are contemplated and should be considered within the scope of the present disclosure.

Second Ramp Panel

Figure 8:
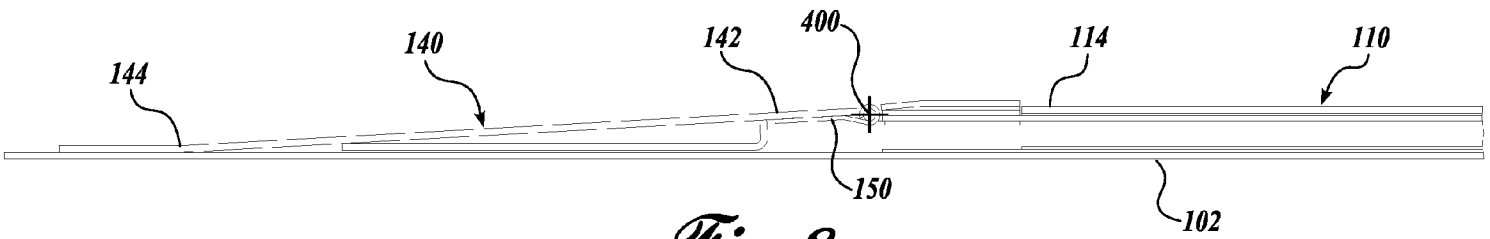
FIG. 8 shows a partial cutaway side view of a second end of the operable ramp of FIG. 3 with the operable ramp in the stowed position.
Figure 9:
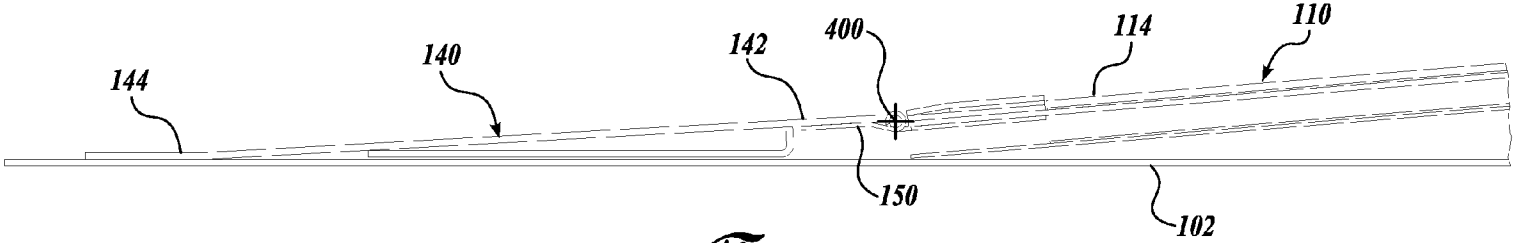
FIG. 9 shows a partial cutaway side view of the second end of the operable ramp of FIG. 3 with the operable ramp in the deployed position.
Figure 18:
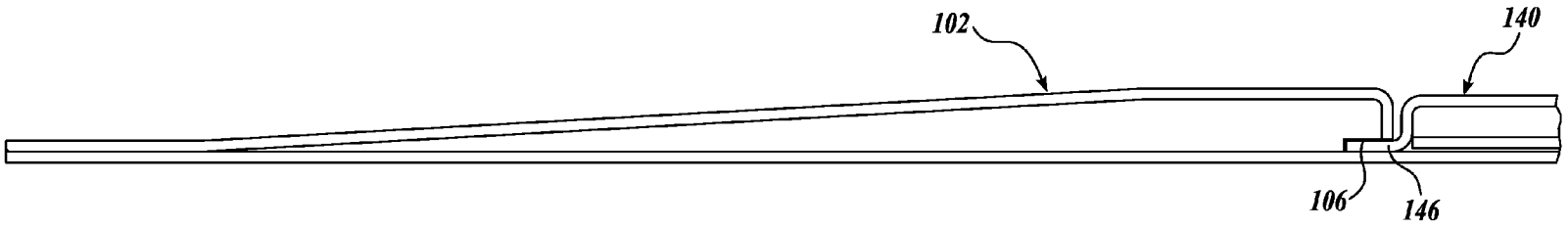
FIG. 18 shows a partial cutaway rear end view of the operable ramp of FIG. 3 in the deployed position.

Referring now to FIGS. 8 and 9, a second end 114 of the first ramp panel 110 is rotatably coupled to a first end 142 of a second ramp panel 140 by a hinge 150 about axis 400. The second ramp panel 140 is slidably coupled to the base 102, preferably in a manner that prevents rotation of the second ramp panel relative to the base 102. As shown in FIGS. 3, 4, and 18, the illustrated embodiment of the second ramp panel 140 includes tabs 146 that extend laterally into slots 106 formed in the base. As will be described later, the second end 114 of the first ramp panel 110 is supported by the hinged connection to the second ramp panel 140 when the operable ramp 100 is in the deployed position. The slotted engagement of the second ramp panel 140 with the base 102 allows the second ramp panel to slide relative to the base, while preventing the weight of the first ramp panel 110 from rotating the second ramp panel to drive down the hinged connection between the panels, which would raise the second end 144 of the second ramp panel.

Referring back to FIGS. 8 and 9, the second ramp panel 140 has a sloped upper surface. In this regard, the first end 142 of the second ramp panel is higher than a second end 144 of the second ramp panel, so that the upper surface provides a sloped transition from the first ramp panel 110 to the base 102 and/or the first surface 62.

In the illustrated embodiment, the second ramp panel 140 is a generally rectangular panel formed of known materials to have suitable strength and durability such that the panel can withstand user traffic in both the stowed and deployed positions. In one exemplary embodiment, the second ramp panel 140 is formed from one or more pieces of sheet metal (such as aluminum or steel), with a plurality of stiffeners attached to the bottom of the panel to provide additional stiffness and to maintain an upper surface of the panel at a predetermined angle. A texture is preferably formed integrally with or applied to the upper surface of the second ramp panel 140 to provide improved traction.

Housing

Figure 10:
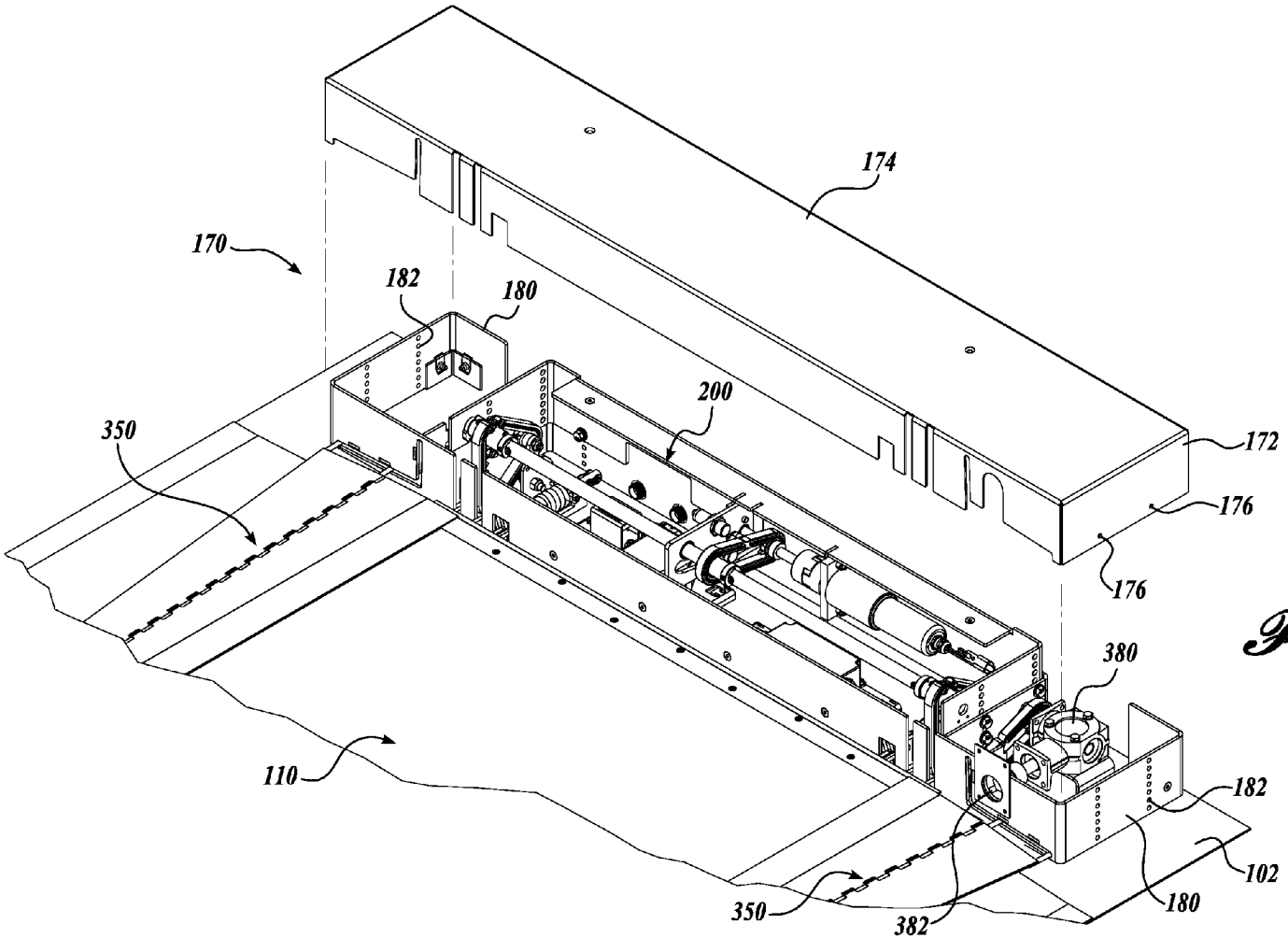
FIG. 10 shows an exploded front isometric view of a drive assembly housing positioned at a first end of the operable ramp of FIG. 3, wherein a housing closeout is removed from the housing.
Figure 11:
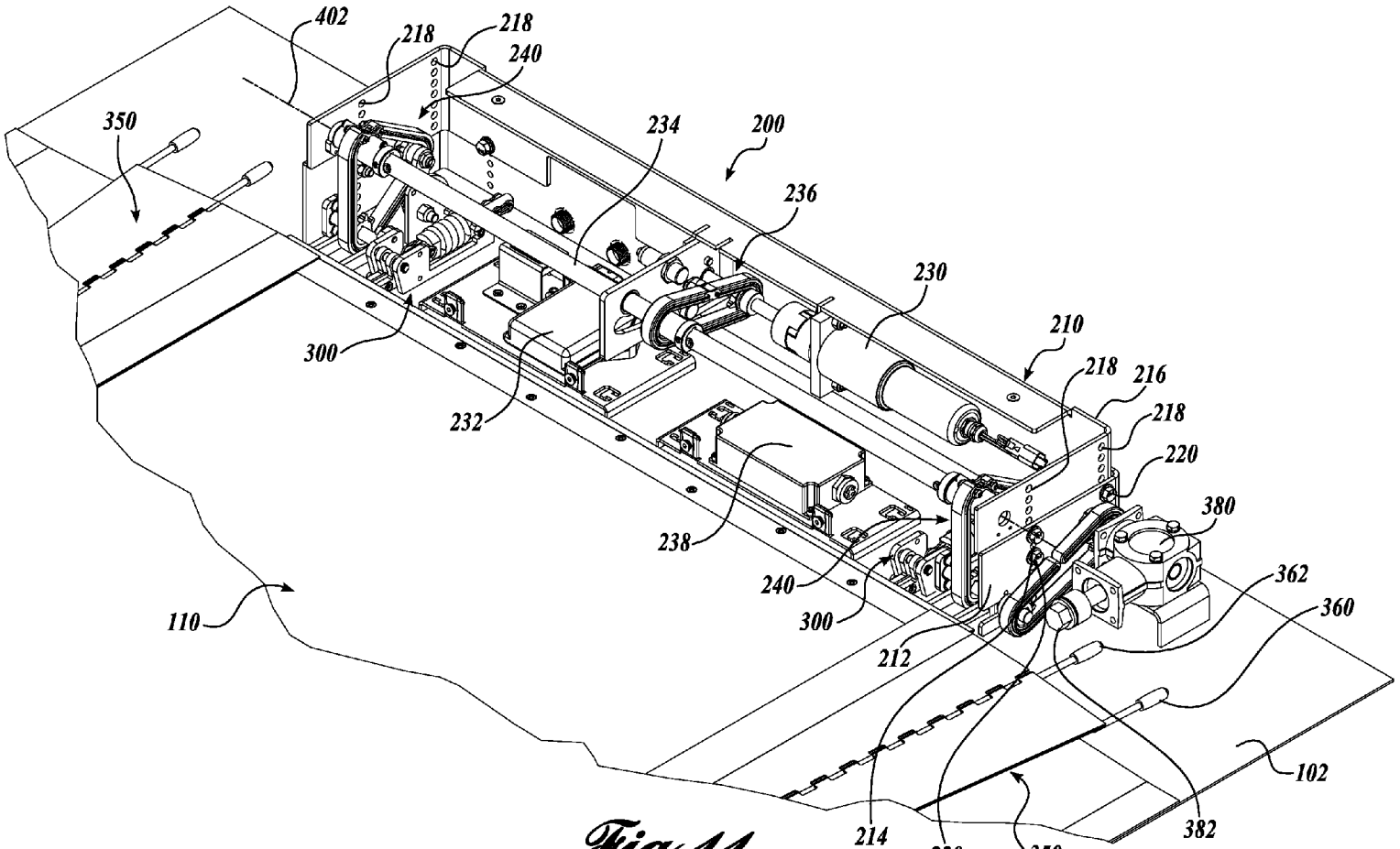
FIG. 11 shows a front isometric view of a drive assembly of the operable ramp of FIG. 3 with the drive assembly housing removed.

As shown in FIGS. 10 and 11, the housing 170, which contains the drive assembly 200, includes a base 180 that forms at least part of a rectangular structure with vertical walls. A plurality of holes 182 are formed in the walls of the base 180. A rectangular housing closeout 172 is sized and configured to at least partially receive and also be supported by the base 180. The closeout 172 includes holes 176 disposed therein, wherein each hole 176 in the closeout corresponds to more than one of the holes 182 in the base 180. In this regard, the holes in the base 180 are arranged in vertical groups around the base so that the height of the closeout 172 and, therefore, the housing 170 can be selected by aligning the holes 176 in the closeout 172 with different groups of holes 182 in the base 180 and then securing the closeout to the base with fasteners 178 that extend through corresponding holes in the base and closeout. As a result, the height of the housing 170 is selectively adjustable to correspond to the height of the step 56 in the architectural setting in which the operable ramp 100 is installed.

In one contemplated embodiment, the height of the step is adjustable between 4 inches and 7 inches. In another contemplated embodiment, the height of the housing is adjustable in ½ inch increments. It will be appreciated that the range of closeout heights can vary, as well as the increments in which the heights can be varied. In addition, different configurations to adjustably couple the closeout to the base are contemplated. These and other embodiments of a housing that (1) provide an enclosure for the drive assembly and (2) have an upper surface with a selectively adjustable height are contemplated and should be considered within the scope of the present disclosure.

Drive Assembly

Still referring to FIGS. 10 and 11, the drive assembly 200 includes an adjustable drive support 210 to which various components of the drive assembly are mounted. The drive support 210 includes a lower support 212 that is fixedly mounted relative to the base 102. In the illustrated embodiment, the lower support 212 is formed from sheet metal positioned to provide mounting locations for certain components of the drive assembly 200. A plurality of apertures 214 are formed in the lower support 212.

The drive support 210 also includes an upper support 216 that is adjustably mountable to the lower support 212. Similar to the lower support 212, the disclosed embodiment of the upper support 216 is formed from sheet metal with a plurality of apertures 218 formed therethrough. The upper support 216 and apertures 218 are sized and configured so that the upper support can be positioned at different locations relative to the lower support 212 and secured in place using fasteners 220 extending through corresponding apertures 214 and 218 in the upper and lower supports. In this way, an installer can selectively adjust the position of the upper support 216 relative to the lower support 212. Like the lower support 212, the upper support 216 also provides locations to which certain components of the drive assembly 200 can be mounted. As a result, an installer can selectively adjust the position of certain drive assembly 200 components relative to each other by adjusting the position of the upper support 216 relative to the lower support 212.

It will be appreciated that the illustrated drive support 210 is exemplary only and should not be considered limiting. In this regards, various alternate embodiments that allow for the selective adjustment of the position of various drive assembly 200 components relative to each other are contemplated, and such alternate embodiments should be considered within the scope of the present embodiment.

As best shown in FIG. 11, the drive assembly 200 includes a motor 230 mounted to the upper support 216 and is operably coupled to a controller 232, which controls the operation of the motor according to various operator inputs and operating conditions. A power supply 238 provides power to drive the motor. A drive shaft 234 is rotatably mounted about an axis 402 to the upper support 216. The motor 230 is coupled to the drive shaft 234 by a known transmission 236 so that the motor selectively rotates the drive shaft about axis 402. The drive shaft 234 extends across the width of the operable ramp 100 and is coupled at each end to a chain assembly 240. In the illustrated embodiment, the chain assemblies 240 are similar. Accordingly, one chain assembly 240 will be described with the understanding that the other chain assembly is likewise configured. The drive assembly also includes one or more proximity sensors (not shown) operatively connected to the controller 232 to identify when the operable ramp is in a stowed position and a deployed position.

Figure 12:
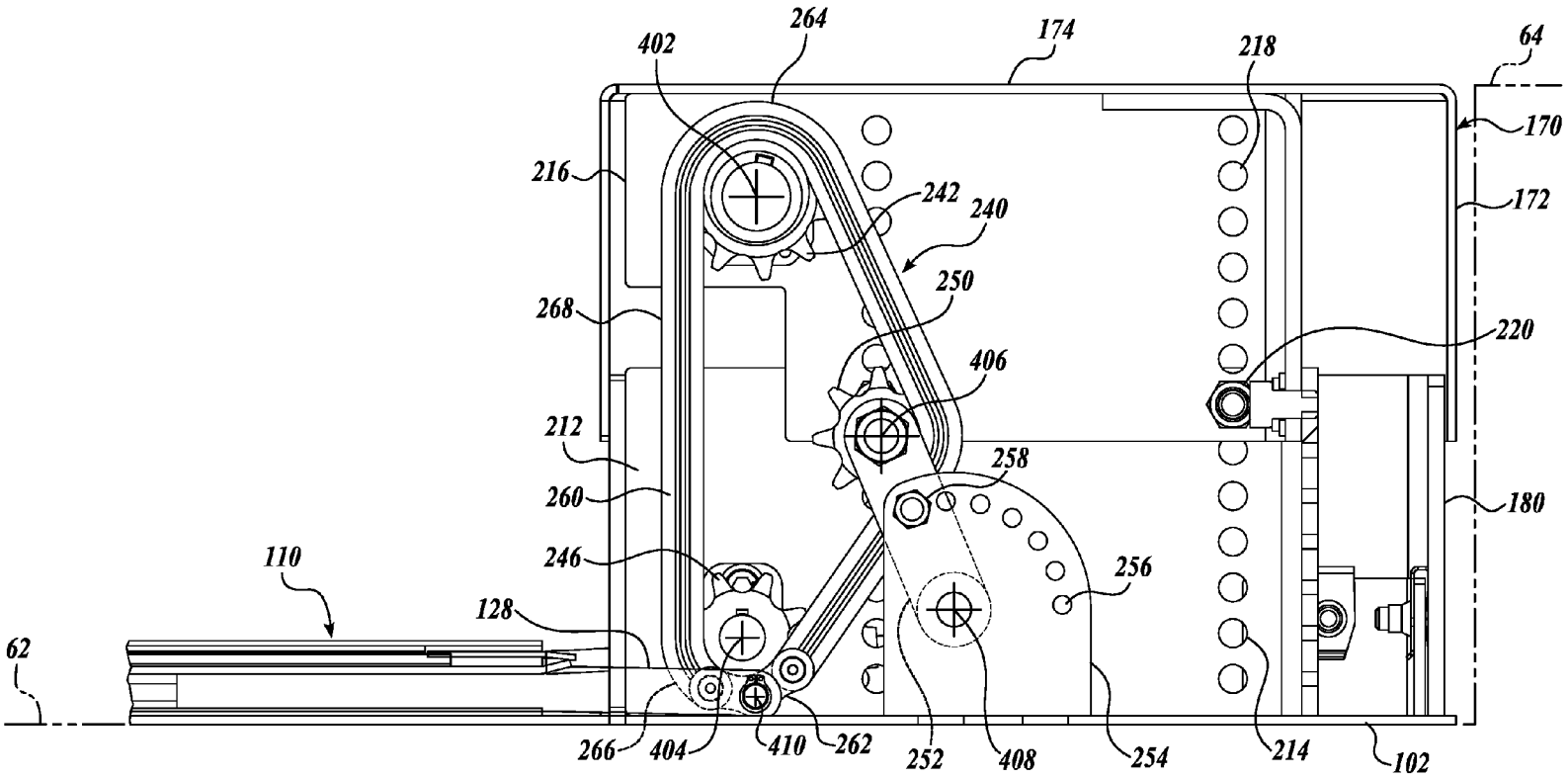
FIG. 12 shows a partial cutaway side view of the drive assembly of FIG. 11 with the operable ramp in the stowed position and the operable ramp configured for a first step height.
Figure 13:
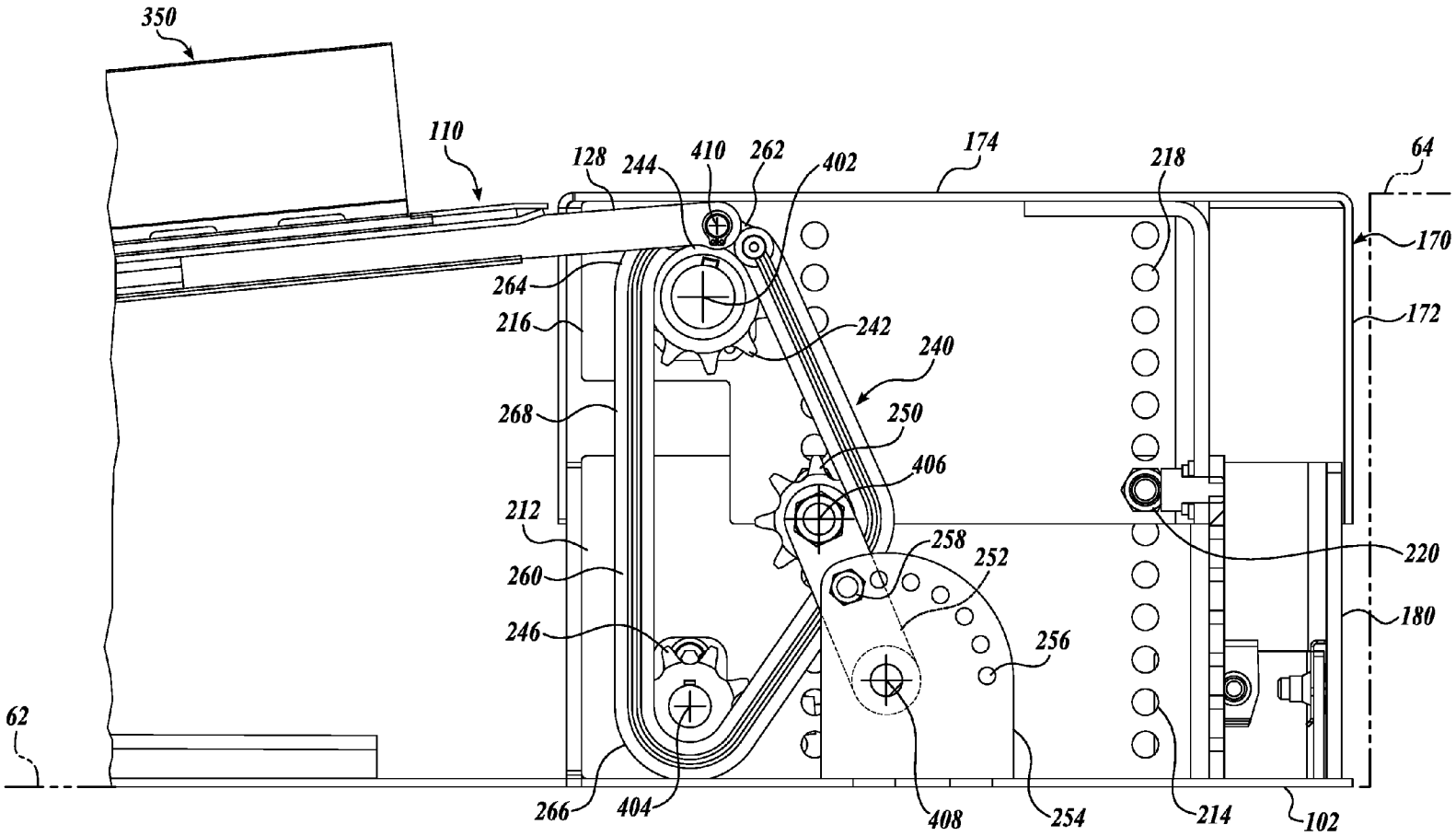
FIG. 13 shows a partial cutaway side view of the drive assembly of FIG. 12 with the operable ramp in the deployed position and the operable ramp configured for the first step height.

Referring now to FIGS. 12 and 13, a side view of one chain assembly 240 is shown with the operable ramp in the stowed position (FIG. 12) and the deployed position (FIG. 13). The chain assembly 240 includes an upper sprocket 242 and a lower sprocket 246. The upper sprocket 242 is coupled to the drive shaft 234 so that rotation of the drive shaft rotates the upper sprocket about the drive shaft axis 402. The lower sprocket 246 is coupled to the lower support 212 or some other fixed structure to be rotatable about an axis 404 that is parallel to the drive shaft axis 402.

A chain 260 forms an endless loop that engages the upper and lower sprockets 242 and 246. As previously described, the position of the upper support 216, to which the axis 402 of the upper sprocket 242 is fixedly positioned, is selectively adjustable relative to the lower support 212, to which the axis 404 of the lower sprocket 246 is fixedly positioned. As a result, adjustment of the upper support 216 relative to the lower support 212 changes the distance between the upper sprocket 242 and the lower sprocket 246. To account for this change, a selectively positionable idler sprocket 250 engages the chain 260. The idler sprocket 250 allows the path of the chain 260 to be modified so that the length of the chain path can be maintained when the distance between the upper sprocket 242 and the lower sprocket 246 changes. This in turn prevents the chain 260 from becoming too taut or too slack.

The idler sprocket 250 is rotatably mounted to an elongate support arm 252 about an axis 406, which is parallel to the upper sprocket axis 402 and the lower sprocket axis 404. The support arm 252 is rotatably mounted to a support bracket 254 about axis 408. The bracket is fixedly positioned relative to the lower support 212 and includes a plurality of holes 256 positioned circumferentially about axis 408. The position of the idler sprocket 250 is adjusted by rotating the support arm 252 about axis 408 until the idler sprocket is in a desired position and then securing the support arm relative to the support bracket 254. In the illustrated embodiment, a the support arm 252 is secured to the support bracket 254 using a fastener 258 that extends through a hole (not shown) in the support arm and one of the corresponding holes 256 in the support bracket.

The disclosed support bracket 254 is fixedly positioned relative to the base 102 and the lower support 212; however, alternate embodiments are contemplated in which the support bracket is coupled to the upper support 216 or any other suitable structure. It is also contemplated that other idler sprocket configurations can be utilized. In one alternate embodiment the idler sprocket is mounted to a support that is biased by a spring element to maintain a desired tension on the chain. These and other configurations to maintain a desired tension for a range of upper and lower sprocket positions are contemplated and such configurations should be considered within the scope of the present disclosure.

Figure 14:
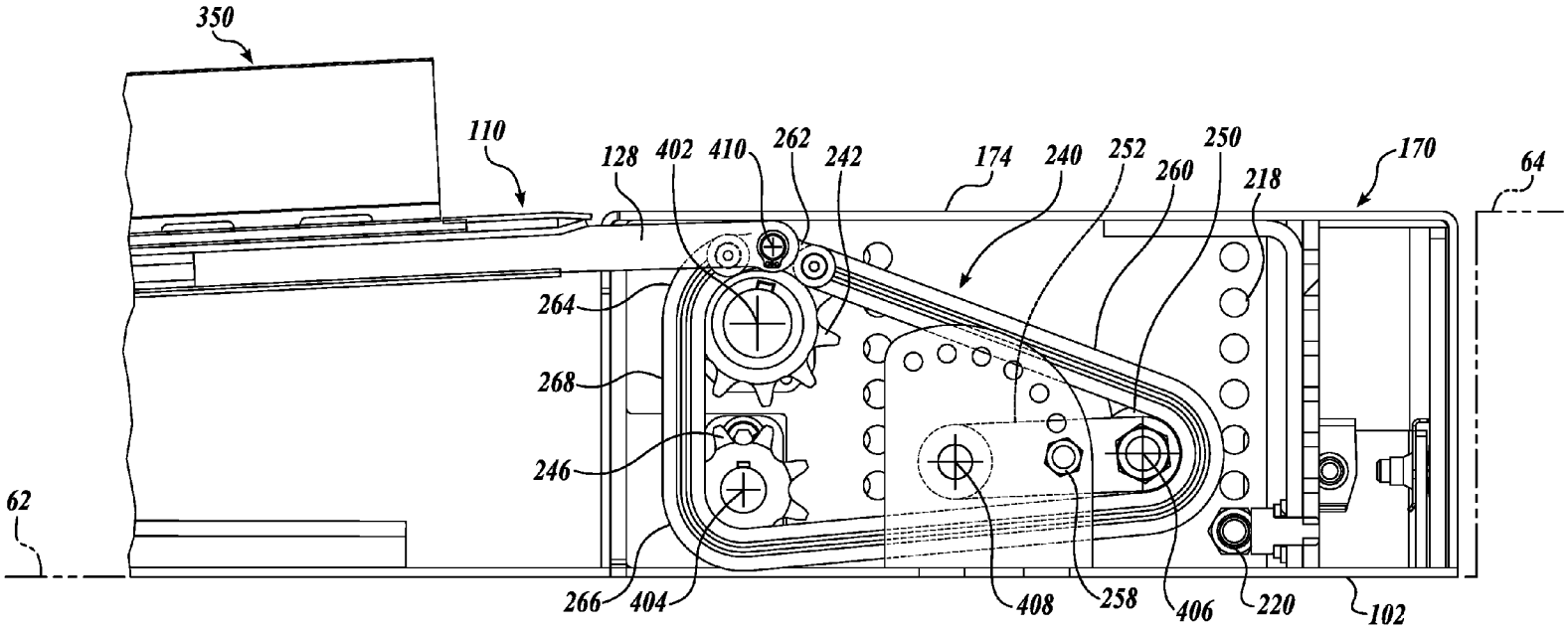
FIG. 14 shows a partial cutaway side view of the drive assembly of FIG. 12 with the operable ramp in the deployed position and the operable ramp configured for a second step height.

FIGS. 12 and 13 show the operable ramp 100 in stowed and deployed positions, relatively, when the operable ramp is configured for installation in conjunction with a step having a taller riser, for example, a 7 inch riser. FIG. 14 shows the operable ramp 100 configured for installation in conjunction with a shorter step, for example, a step with a 4 inch riser. To accommodate the shorter step, the upper support 216 of the drive support 210 is mounted to the lower support 212 such that the upper sprocket 242 is closer to the lower sprocket 246. This in turn reduces the vertical travel of the coupler 262 and, therefore, the first end 112 of the first ramp panel 110. The idler sprocket 250 is repositioned to account for undesired slack in the chain that would result from the reduced distance between the upper and lower sprockets 242 and 246. The closeout 172 is mounted to the housing base 180 so that the upper surface 174 of the closeout is generally level with the second surface 64 of the architectural setting. By providing adjustability in the drive support 210 and housing 170, the present operable ramp provides a housing that can be matched to the height of different steps and an inclined ramp surface that can be configured to account for the different step heights.

Referring back to FIGS. 12 and 13, the first ramp panel 110 is coupled to the drive assembly 200 by a plurality of elongate support elements 128 fixedly secured to the first end 112 of the panel. More specifically, support elements 128 extend from the first end 112 of the first ramp panel 110 and are generally parallel with the upper surface of the first ramp panel. Each support element 128 is rotatably coupled to one of the chain assemblies 240 about axis 410. In the illustrated embodiment of FIGS. 12 and 13, the support element 128 is rotatably coupled to the chain 260 by a coupler 262 that forms part of the chain. As the chain moves along the path of its endless loop, the end of the support element 128 move with the chain to reciprocate the first ramp panel 110 between the stowed position of FIG. 12 and the deployed position of FIG. 13.

In the illustrated embodiment, the path of the chain 260 includes two arcuate portions 264 and 266 where the chain engages the upper sprocket 242 and lower sprocket 246, respectively. The chain also includes a linear portion 268 extending between the arcuate portions 264 and 266.

In other contemplated configurations, a rotatable drive arm or other suitable linkage is used in place of the chain assembly 240 to move the coupler 262 along a predetermined path. Further, the path of the coupler 262 can vary. In one contemplated embodiment, such as when a rotating drive arm is utilized, the coupler 262 follows an arcuate path through the entire deployment motion. These and other configurations are contemplated and should be considered within the scope of the present disclosure.

Counterbalance

In order to reduce the size of the actuating force required from the motor 230 and to reduce wear and tear on the drive assembly 200 components in general, the operable ramp 100 includes a counterbalance 300 disposed within the housing 170 and extending under the first ramp panel 110. The counterbalance 300 applies an upward force $F_C$ to the bottom of the first ramp panel 110 to counteract at least a portion of the weight of the first ramp panel. In doing so, the counterbalance 300 allows for the use of a smaller, more compact motor 230 and prolongs the life of the drive assembly 200.

Figure 15:
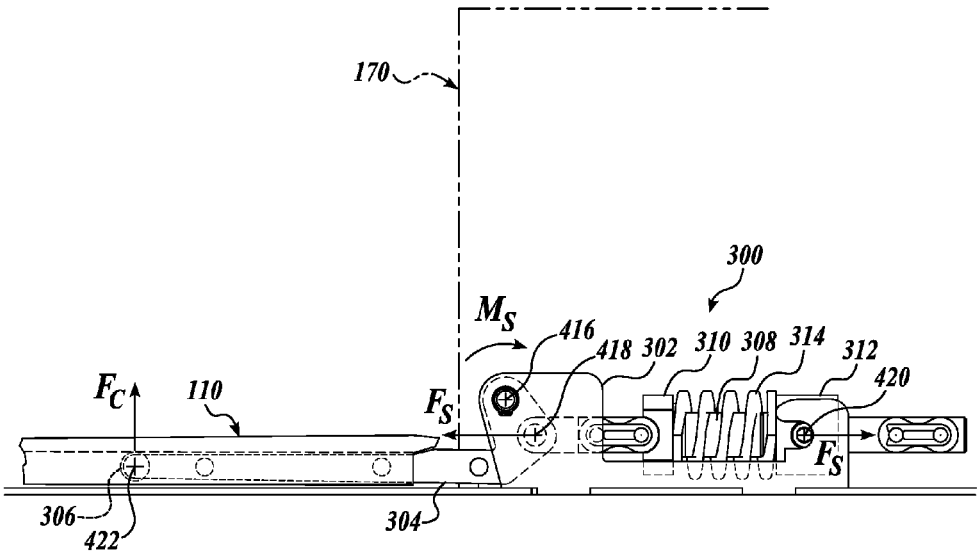
FIG. 15 shows a side view of a counterbalance of the operable ramp of FIG. 3 with the operable ramp in the stowed position.
Figure 16:
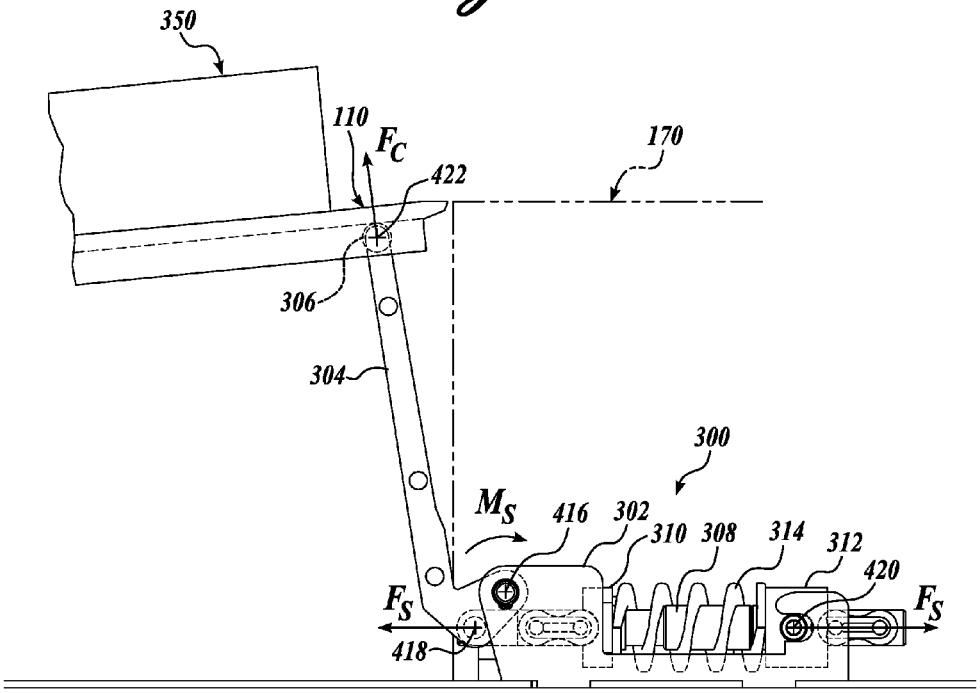
FIG. 16 shows a side view of the counterbalance of FIG. 15 with the operable ramp in the deployed position

As shown in FIGS. 15 and 16, the counterbalance 300 includes a mounting fitting 302 coupled to the frame 102 or other suitable structure within the housing 170. A link 304 is rotatably coupled at one end to the mounting fitting 302 about an axis 416. A second end of the link 304 has a roller bearing 306 rotatably mounted to the link about an axis 422 or another suitable bearing element or surface disposed thereon. The roller bearing 306 rollingly or slidingly engages a lower surface of the first ramp panel 110. In the illustrated embodiment, a slot is formed in the lower plate 120 of the first ramp panel 110 so that the roller bearing 306 engages the corrugated layer 122. In this manner, when the operable ramp 100 is in the stowed position, the link 304 extends into a channel in the corrugated layer 122, thereby reducing the height of the ramp portion of the operable ramp 110 in the stowed position. In contemplated alternate embodiments, a static bearing surface is disposed at the end of the link 304 and slidingly engages the first ramp panel 110.

A biasing element 310 in the form of a cylindrical fitting is fixedly coupled to the rod 308 proximate to the link 304. A spring fitting 312 is slidably coupled to a rod 308 opposite the biasing element 310. The spring fitting 312 is rotatably coupled to the mounting fitting 302 about axis 420. The rod 308 is rotatably coupled at one end to the link 304 about axis 418 so that rotation of the link 304 rotates the spring fitting 312 about axis 420

A spring 314 is disposed between the biasing element 310 and the spring fitting 312. In the illustrated embodiment, the spring 314 is a compression spring positioned such that the rod 308 extends through the coils of the spring. The spring 314 engages the biasing element 310 and the spring fitting 312, which are configured such that the ends of the spring are restrained thereby. The spring 314 is sized and configured to have a preload that is reacted by the biasing element 310 and the spring fitting 312. The spring fitting 312 is rotatably coupled to mounting fitting 302 and, therefore, the spring force $F_S$ applied to the spring fitting by one end of the spring 314 is reacted out through the mounting fitting. The spring force $F_S$ applied to the biasing element 310 at the other end of the spring is reacted out through the rod 308 by virtue of its fixed connection to the biasing element. As a result, the spring force $F_S$ is applied to the link 304 through axis 418.

The spring force $F_S$ applied to the link 304 results in a moment $M_S$ about axis 416. The moment $M_S$ is reacted through roller bearing 306 into a lower surface of the first ramp panel 110. That is, the roller bearing 306 applies a counterbalance force $F_C$ to the first ramp panel 110. The counterbalance force $F_C$ is applied normal to the lower surface of the first ramp panel 110 and biases the first ramp panel and, therefore, the operable ramp 100 toward the deployed position.

It will be appreciated that the counterbalance 300 can be configured to provide a desired counterbalance force $F_C$ throughout the motion of the ramp. In this regard, the spring preload, spring constant k of the spring, the magnitude and variation of the moment arm throughout the travel of the operable ramp, as well as other factors can be modified to provide a desired performance curve. Further, multiple springs, various other types of springs, such as torsion springs, extension springs, non-linear springs, gas springs, etc., may be employed to provide a particular counterbalancing profile. These and other alternate configurations that provide a biasing force can be implemented and should be considered within the scope of the present disclosure.

Side Curb Assemblies

Figure 17:
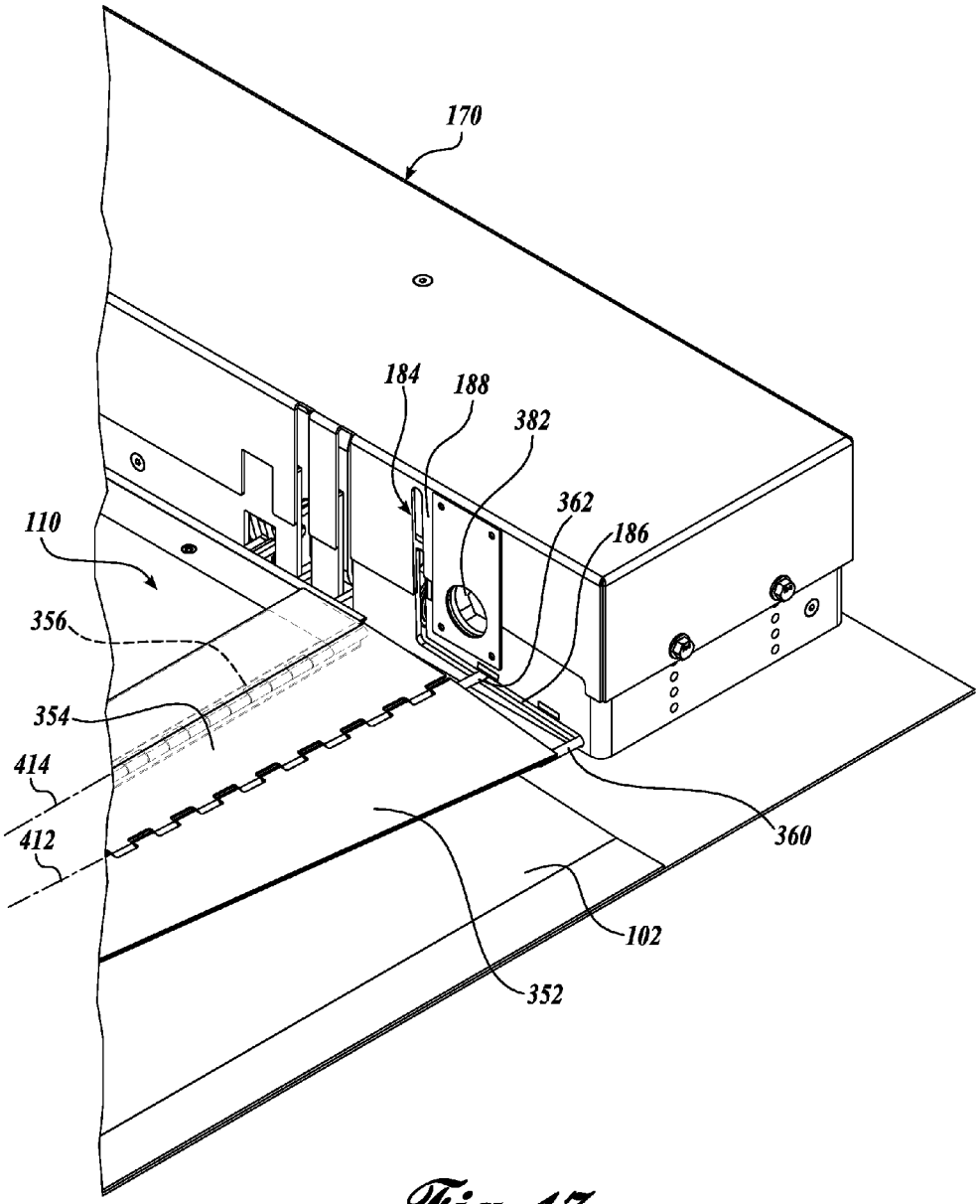
FIG. 17 shows a front partial isometric view of the operable ramp of FIG. 3.

As best shown in FIGS. 7 and 17, side curb assemblies 350 are positioned along the lateral edges 116 of the first ramp panel 110. When the operable ramp 100 is in the stowed position, the side curb assemblies 350 lie flat. As the operable ramp 100 moves to the deployed position, the side curb assemblies 350 move to a position in which the assemblies extend upward along the side edges of the first ramp panel 110 to prevent a user from accidentally dropping off of the side of the ramp. The side curb assemblies 350 also extend downward to act as a closeouts that blocks the area under the first ramp panel 110 when in the deployed position, thereby improving safety by minimizing the risk of a "pinch" type injury.

Each side curb assembly 350 includes a lower plate 352 hingedly coupled to an upper plate 354 about an axis 412. The upper plate 354 is hingedly coupled to a lateral edge 116 of the first ramp panel 110 about an axis 414 by a hinge 356. An outer pin 360 is positioned parallel to axis 412 and extends from an outer edge of the lower plate 352 into an L-shaped slot 184 formed in the housing 170. An inner pin 362 is positioned approximately along axis 412 and also extends into the slot 184.

When the operable ramp 100 is in the stowed position, the side curb assembly 350 lays essentially flat along the first ramp panel 110 and the base 102, with outer pin 360 and inner pin 362 extending into a lower horizontal portion 186 of the slot 184. As the operable ramp 100 moves to the deployed position, the first end 112 of the first ramp panel 110 moves upward, which also moves axis 414 upward. At the same time, the inner pin 362 moves along the slot 184 into a vertical portion 188 of the slot. As best shown in FIG. 7, the movement of axis 414 with the first ramp panel 110 and the movement of the inner pin 362 within the slot 184 raise the upper plate 354 and also rotates the upper plate about axis 414 such that a portion of the upper plate extends upward from axis 414 along the edge of the first ramp panel. A portion of the upper plate also extends downward from axis 414. As the upper plate 354 moves upwards and rotates, the lower plate 352, moves by virtue of its hinged connection to the upper plate and the engagement of the outer pin 360 with the horizontal leg 186 of the slot 184. In doing so, the lower plate 352 spans the distance from the lower edge of the upper plate 354 to the upper surface of the base 102.

Ramp Operation

When the operable ramp 100 is in the stowed position of FIGS. 1, 3, and 12, the operable ramp 100 integrates with the step 56 of the architectural environment. The upper surface 174 of the housing is generally coplanar with the tread 58 of the step 56, and the tread surface 126 of the first ramp panel 110 is essentially horizontal and parallel to the first surface 62 of the architectural environment. In the illustrated embodiment, the thickness of the operable ramp 100 at the first ramp panel 110 is approximately 1 inch, although other embodiments with greater or lesser thicknesses are possible. The second ramp panel 140 and the base 102, which extends outwardly from the lateral edges of the first ramp panel 100, both have inclined surfaces that provide a smooth transition from the tread surface 126 of the first ramp panel 110 to the first surface 62 of the architectural environment. Because of the thin profile of the first ramp panel 110 and the transitions provided by the base 102 and second ramp panel 140, it is not necessary to recess the operable ramp 100 below the first surface 62.

Referring now to FIGS. 12 and 13, with the operable ramp 100 in the stowed position (FIG. 12), the coupler 262 and, therefore, the ends of the support elements 128 extend beneath the lower sprocket 246 of the chain assembly 240 so that axis 410, and the first ramp panel 110 is substantially horizontal. To move the operable ramp 100 from the stowed position to the deployed position (FIG. 13), the motor 230 rotates the upper sprocket 242 in a first direction to drive the chain 260 in a first direction (clockwise as viewed in FIGS. 12 and 13) along the path of the endless loop, thereby raising the coupler 262 and, thus, the end of the support elements 128. As the coupler 262 moves along the arcuate portions 264, 266 and the linear portion 268 of the path of the endless loop, the vertical displacement raises the first end 112 of the first ramp portion 110. The second ramp panel 140 slides relative to the base 102 to account for the horizontal displacement of the coupler 262 along the arcuate portions 264 and 266 to prevent binding. The second ramp panel 140 also supports the second end 114 of the first ramp panel 110.

When the operable ramp 100 is in the deployed position, the coupler 262 is slightly over center of the upper sprocket 242. As a result, the support elements 128 extend above the upper sprocket 242 and engage cylindrical shoulders 244 that extend laterally from the upper sprocket. In this manner, the first ramp panel is supported by the upper sprocket 242, which prevents the operable ramp from dropping unexpectedly in the event of a power loss.

To move the operable ramp 100 from the deployed position to the stowed position, the motor 230 rotates the upper sprocket 242 in a second direction opposite the first direction (counter-clockwise as viewed in FIGS. 12 and 13), moving the chain 260 in a second direction along the path of the endless loop to lower the coupler 262. Lowering the coupler 262 lowers the ends of the support elements 128 and, therefore the first ramp panel 110.

It will be appreciated that a number of alternate drive assemblies 200 can be utilized to selectively drive the chain 260 in first and second directions along the endless loop. In one alternate embodiment, two motors are utilized, each motor driving one of the chain assemblies 240 to reciprocate the operable ramp between the stowed position and the deployed position. In another alternate embodiment, instead of the disclosed motor with a rotary output, a linear actuator is operably coupled to each support element 128 through a linkage. These and other configurations that selectively raise and lower the ends of the support elements 128 are contemplated and should be considered within the scope of the present disclosure.

Manual Stow/Deploy

As best shown in FIGS. 11 and 17, a gearbox 380 is operably coupled to one of the chain assemblies 240. The gearbox 380 includes an input shaft having a keyway 382, which is accessible through an access hole formed the housing 170. In the event of a loss of power or a motor failure, an operator can actuate the operable ramp 100 manually. To do so, the operator inserts a crank through the access hole onto the keyway 382 and rotates the crank in a first direction to move the operable ramp 100 toward the deployed position, and in a second direction to move the operable ramp toward the stowed position. It will be appreciated that a number of variations to the illustrated manual deploy and stow mechanism can be incorporated. In this respect, the size, position, and configurations of mechanisms that transfer a manual input into rotation of the chain assemblies 240 can vary, and such variations should be considered within the scope of the present disclosure.

Referring now to FIGS. 19-36, a second representative embodiment of an operable ramp 1100 according to the present disclosure will be described. The second embodiment of the operable ramp 1100 is similar the previously described operable ramp 100, but uses a different mechanism to raise and lower the ramp, among other differences. In the following description, components of the second embodiment that correspond to a similar component in the first embodiment are indicated with a reference number 1XXX, wherein the corresponding component of the first embodiment is indicated with a reference number XXX. For example, the first ramp panel 110 of the previously described embodiment of an operable ramp 100 corresponds to the first ramp panel 1110 of the second embodiment of an operable ramp 1100 described below. For the sake of brevity, some components and subassemblies of the second embodiment and the disclosed environment are not repeated when those components and subassemblies are identical or substantially similar to those of the first embodiment. Accordingly, descriptions of such components and subassemblies can be found by referring to the descriptions of the corresponding components and subassemblies of the previously described embodiment shown in FIGS. 1-18.

Figure 19:
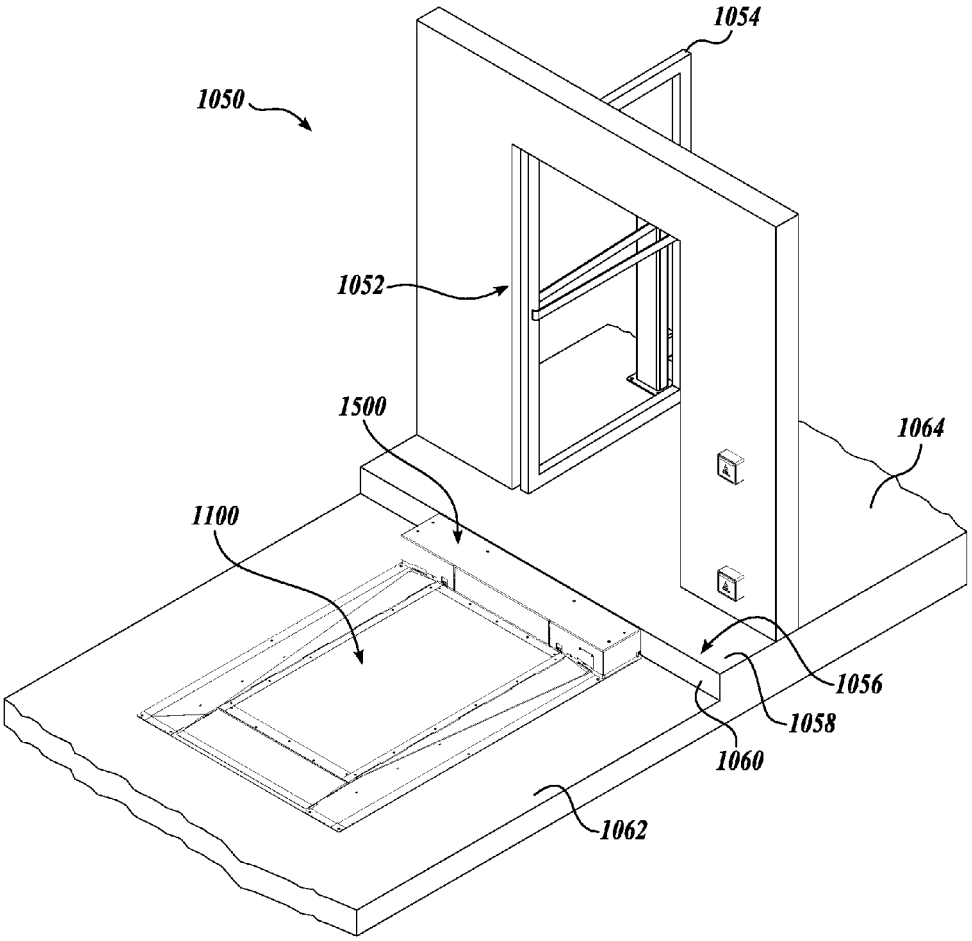
FIG. 19 shows a front isometric view of a second representative embodiment of an operable ramp installed at an entrance to a building, wherein the operable ramp is in a stowed position.
Figure 20:
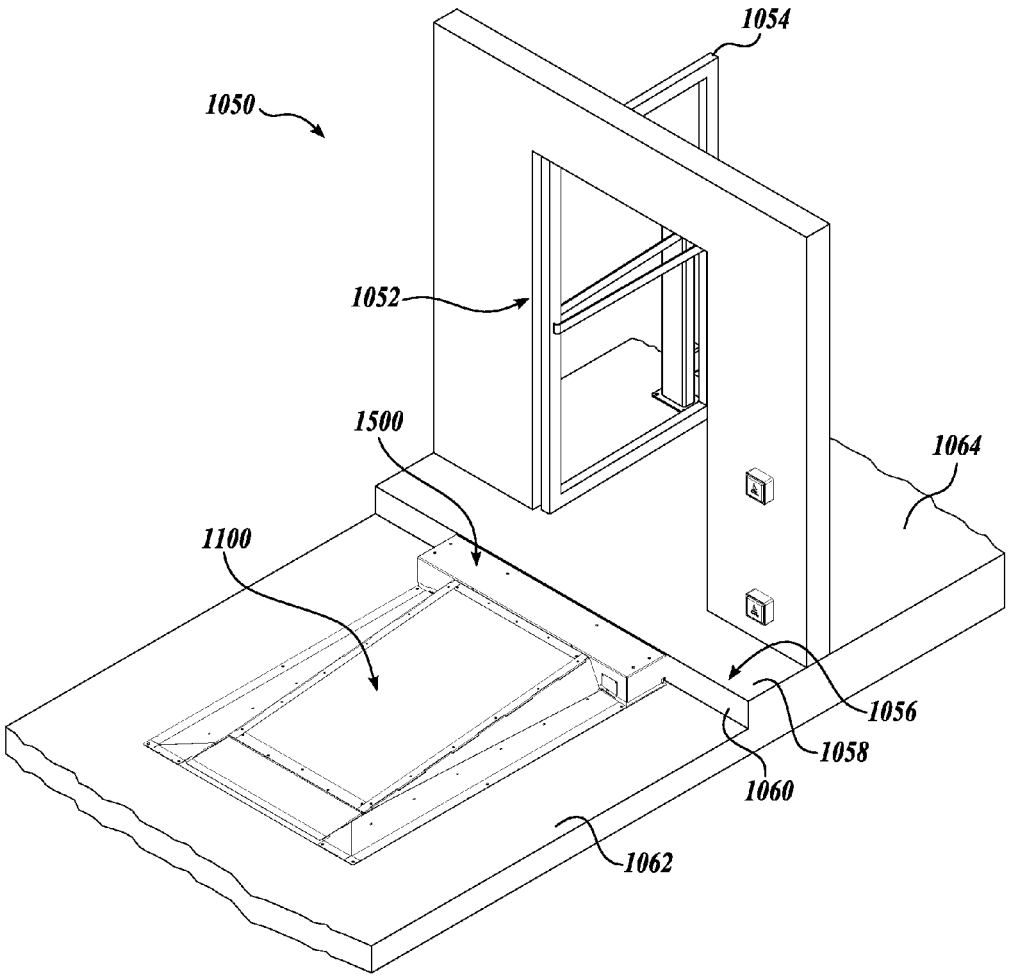
FIG. 20 shows a front isometric view of the operable ramp of FIG. 19 installed at an entrance to a building, wherein the operable ramp is in a deployed position.
Figure 21:
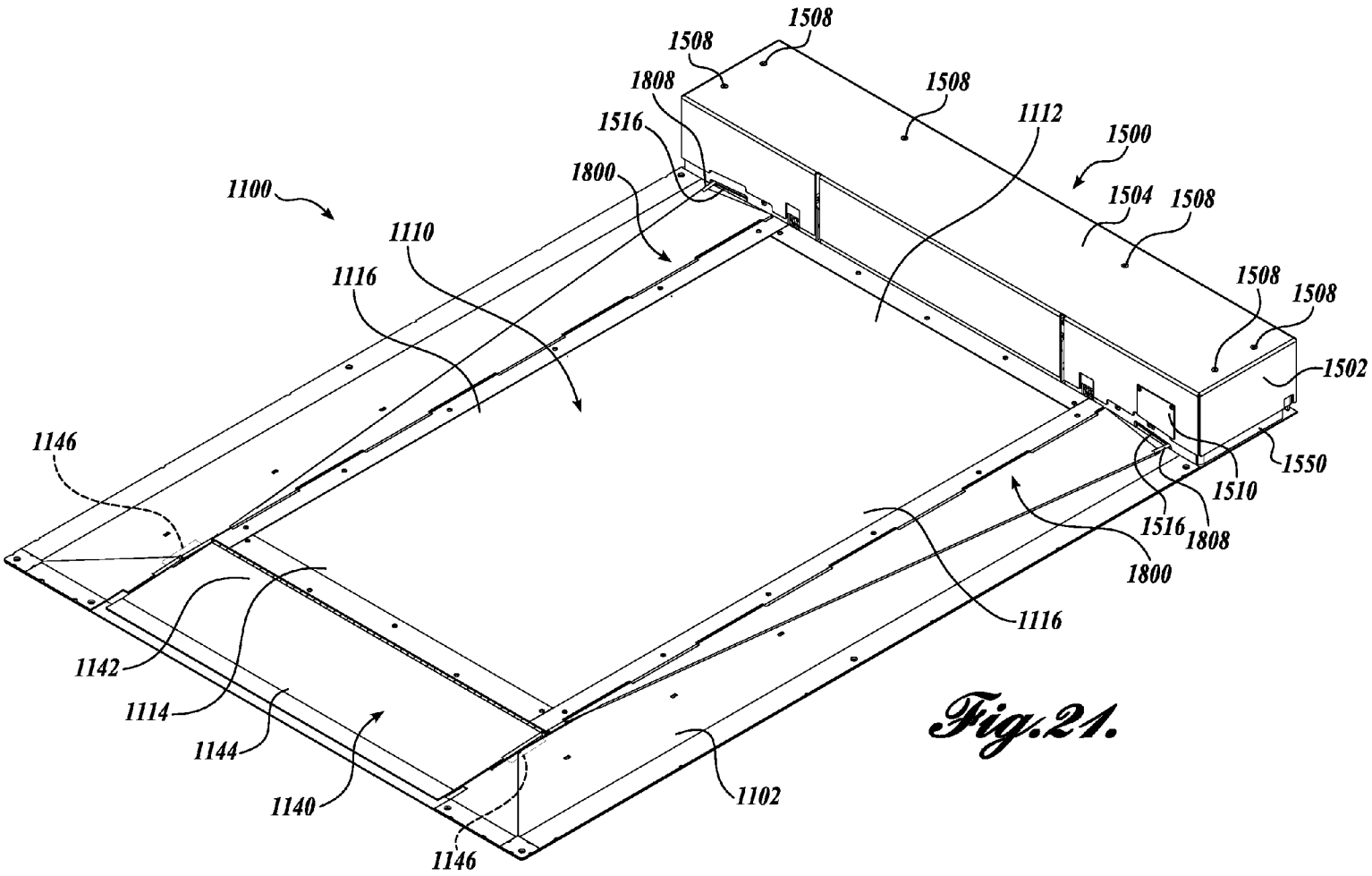
FIG. 21 shows a front isometric view of the operable ramp of FIG. 19 in the stowed position.
Figure 22:
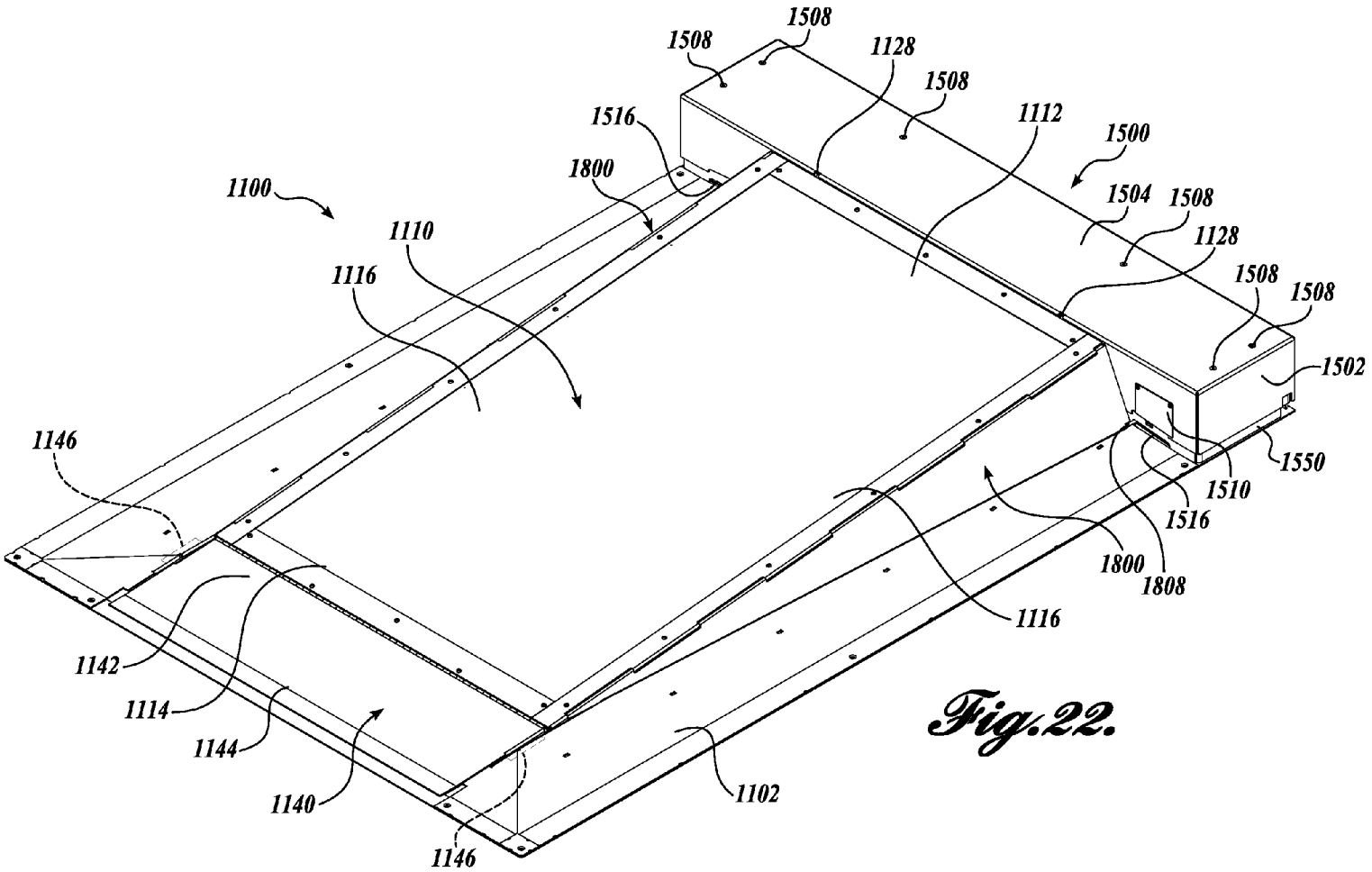
FIG. 22 shows a front isometric view of the operable ramp of FIG. 21 in the deployed position.
Figure 23:
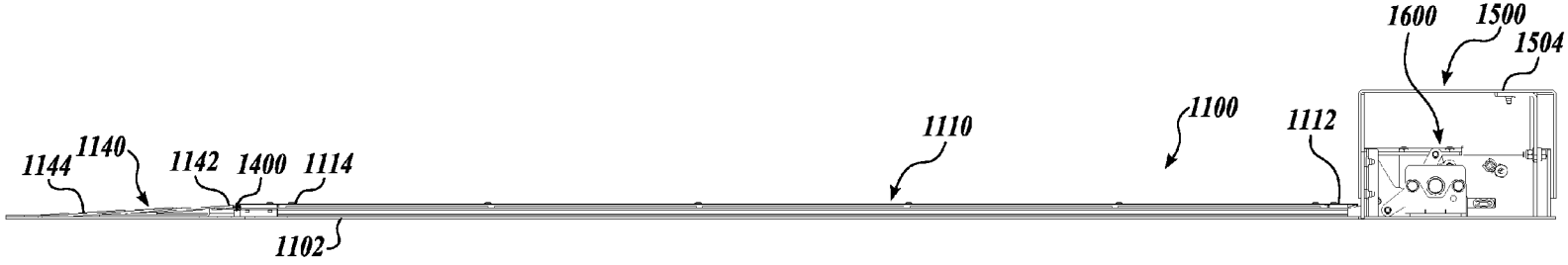
FIG. 23 shows a cutaway side view of the operable ramp of FIG. 21 in the stowed position.
Figure 24:
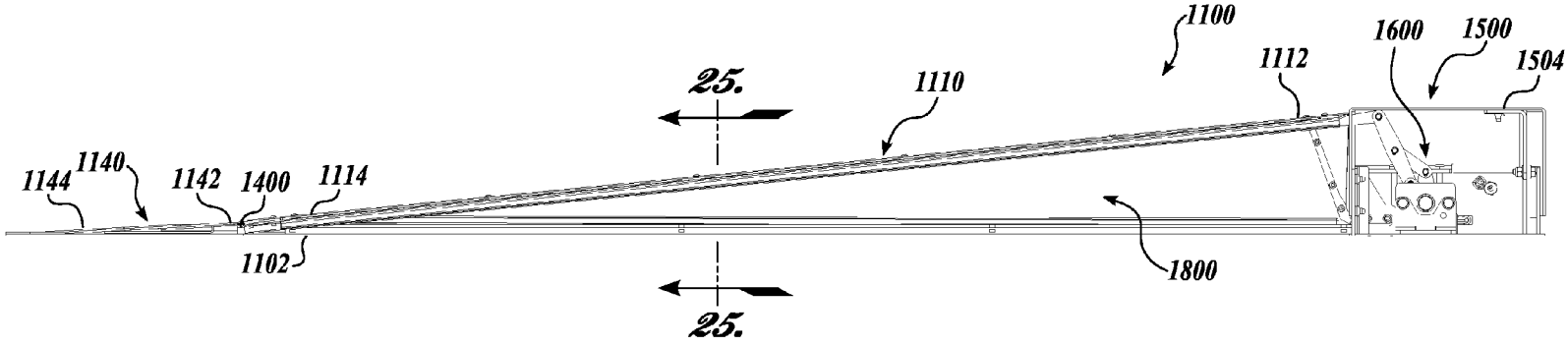
FIG. 24 shows a cutaway side view of the operable ramp of FIG. 22 in the deployed position.
Figure 25:
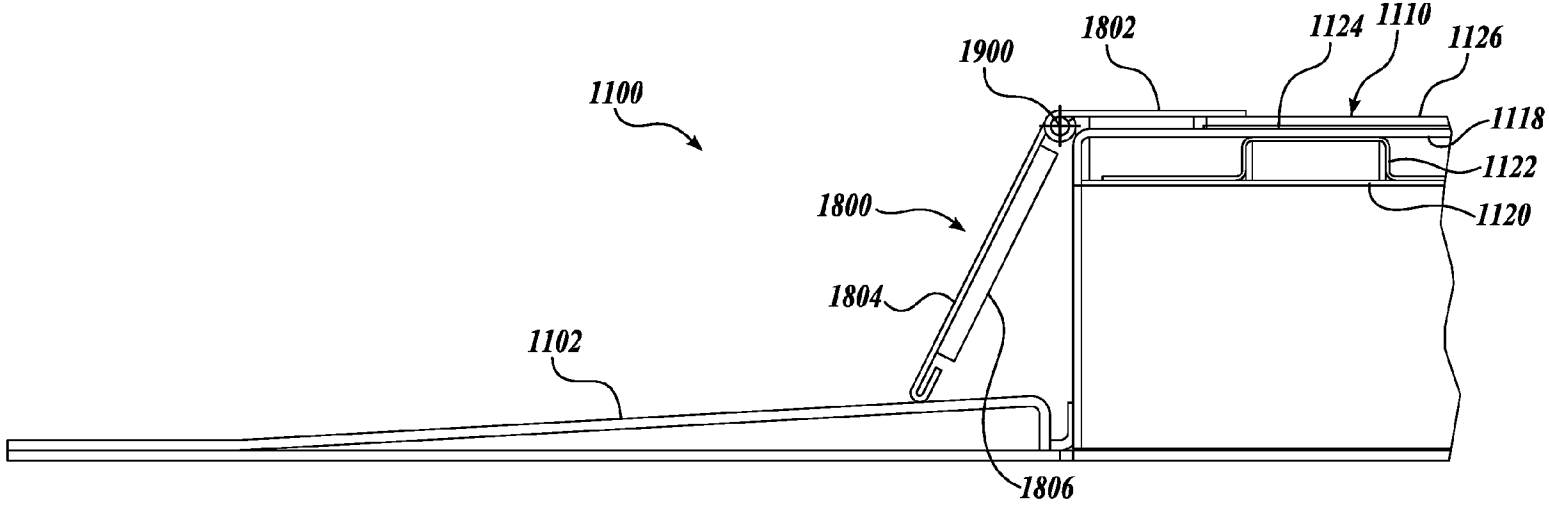
FIG. 25 shows a partial cutaway rear end view of the operable ramp of FIG. 24 in the deployed position.

FIGS. 19 and 20 show the operable ramp 1100 in a stowed position and a deployed position, respectively, while installed at the entrance 1052 of a building 1050. FIGS. 21 and 22 show the same embodiment of an operable ramp 1100 stowed and deployed, respectively, in isolation, i.e., not installed.

The operable ramp 1100 includes a housing 1500 that contains a drive assembly 1600 located proximate to the riser portion 1060. As shown in FIGS. 19 and 20, the housing 1500 is generally rectangular and is sized and configured to be positioned against the riser portion 1060 of the step 1056 so that an upper surface 1504 of the housing 1500 is generally coplanar with the second surface 1064. As a result, the housing 1500 acts as an extension of the second surface 1064, and thus, the step 1056.

First and Second Ramp Panels

Referring to FIGS. 21-24, the operable ramp 1100 includes a first panel 1110 and a second panel 1140 of similar construction and function to the first panel 110 and second panel 140, respectively, of the previously described operable ramp 100. In this regard, the first panel 1110 is rotatably coupled at a second end 1114 to the second panel 1140, which slidably engages the base 1102. A first end 1112 of the first panel 1110 is selectively raised and lowered to reciprocate the operable ramp 1110 between the stowed (lowered) position and the deployed (raised) position.

Housing

Figure 26:
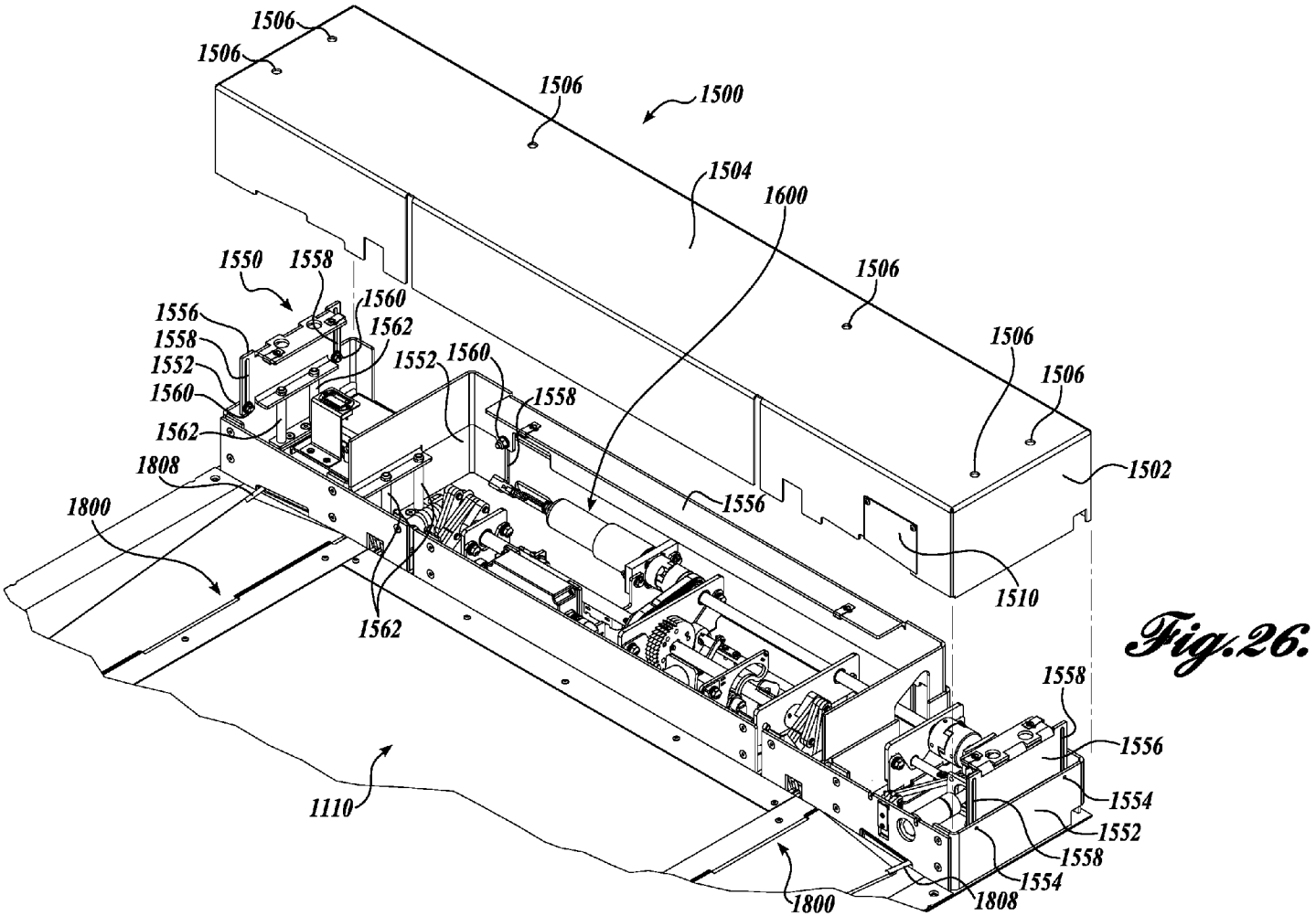
FIG. 26 shows an exploded front isometric view of a drive assembly housing positioned at a first end of the operable ramp of FIG. 21, wherein a housing closeout is removed from the housing.
Figure 27:
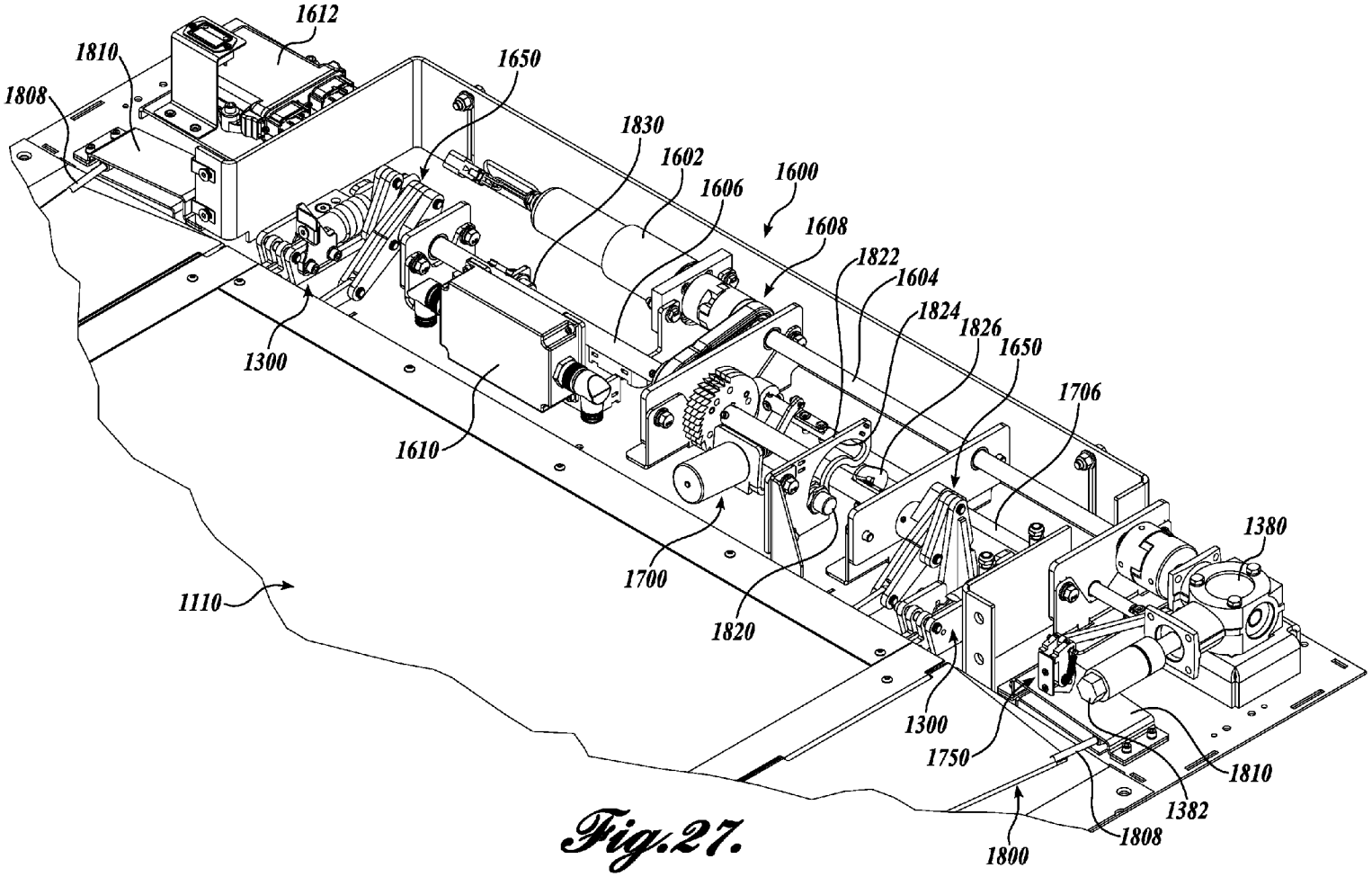
FIG. 27 shows a front isometric view of the drive assembly of the operable ramp of FIG. 26 with the drive assembly housing partially removed.

As shown in FIGS. 26 and 27, the housing 1500, which contains the drive assembly 1600, includes a housing base 1550 that forms at least part of a support structure with an adjustable height. In this regard, the housing base 1550 is selectively adjustable to allow an installer to adjust the height of the upper surface 1504 of the housing 1500 when the housing closeout 1502 is coupled to the housing base 1550. This, in turn, allows the operable ramp 1100 to be adapted to different architectural settings with steps of varying riser height.

The housing base 1550 includes a plurality of fixed elements 1552 fixedly associated to the base 1102 of the operable ramp 1100. The housing base 1550 further includes a plurality of adjustable elements 1556, each coupled to one or more of the fixed elements 1552 and selectively positionable relative to the fixed elements in a vertical direction. In the illustrated embodiment, the fixed elements 1552 include one or more vertical walls having holes 1554 formed therein. The corresponding adjustable elements 1556 include vertical slots 1558, and are adjustably coupled to the fixed elements 1552 by fasteners 1560, each fastener extending through a hole 1554 of a fixed element 1552 and a corresponding vertical slot 1558 of an adjustable element. In this regard, the slots 1558 allow for the fasteners 1560 passing through the fixed element 1552 to secure the adjustable element 1556 to the fixed element in a variety of relative positions.

In the illustrated embodiment, a plurality of cylindrical spacers 1562 are mounted to the base 1102 of the operable ramp 1100 and engage the adjustable elements 1556 to provide additional support to the adjustable elements 1556. It will be appreciated that spacers of different lengths may be employed for different housing heights.

A rectangular housing closeout 1502 is sized and configured to at least partially receive and also be supported by the housing base 1550. The housing closeout 1502 includes holes 1506 disposed therein, wherein each hole in the housing closeout corresponds to a hole in the housing base 1550. The housing closeout 1502 is demountably coupled to the housing base 1550 with fasteners 1508 that extend through corresponding holes in the base and closeout.

In one contemplated embodiment, the height of the step is adjustable between 4 inches and 7 inches. It will be appreciated that the range of closeout heights can vary. In addition, alternate configurations to adjustably couple the closeout to the base of the operable ramp are contemplated. These and other suitable embodiments of a housing that (1) provide an enclosure for the drive assembly and (2) have an upper surface with a selectively adjustable height are contemplated and should be considered within the scope of the present disclosure.

Drive Assembly

Figure 28:
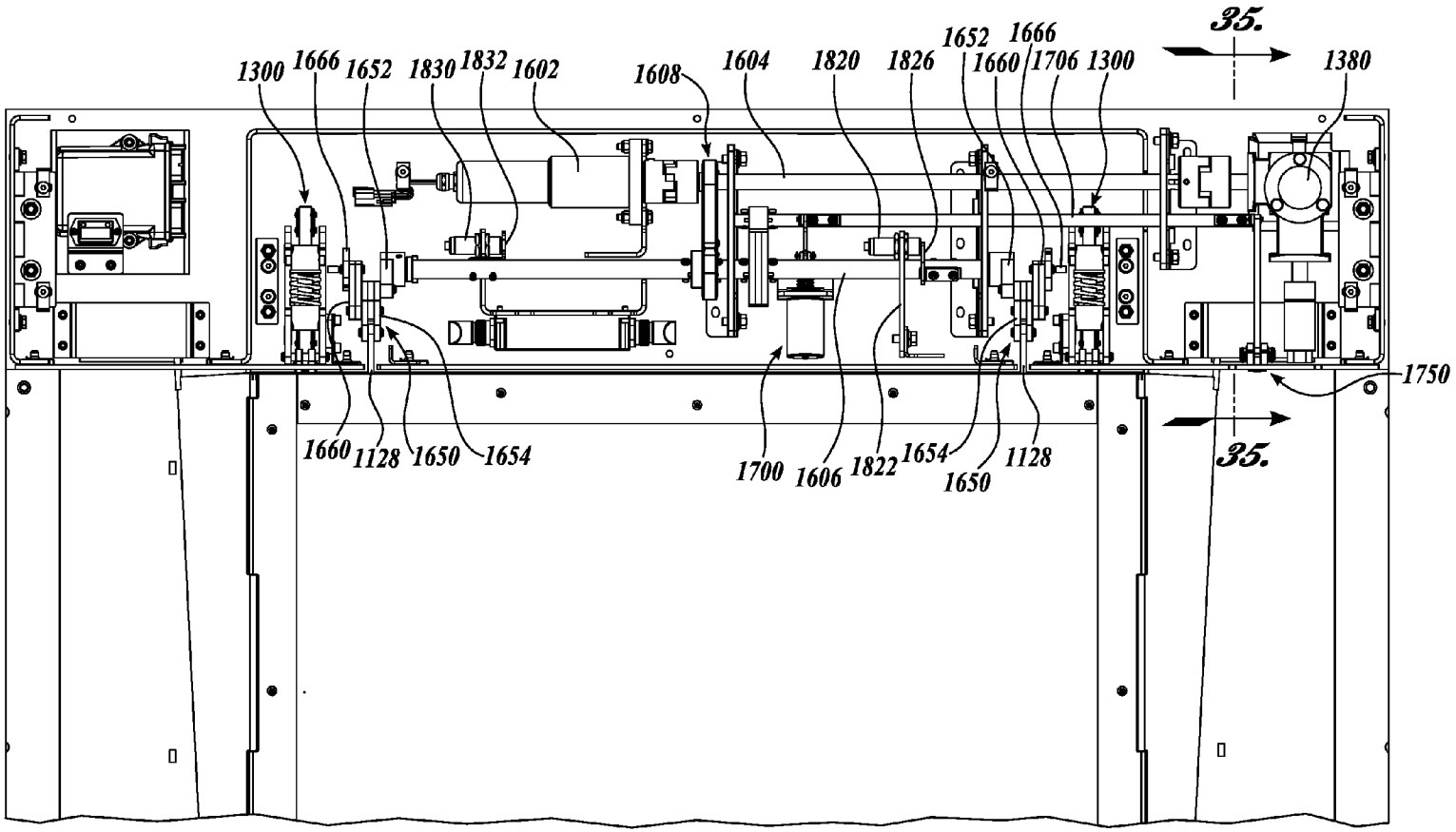
FIG. 28 shows a top plan view of the drive assembly of the operable ramp of FIG. 27.

Referring now to FIGS. 26-28, the drive assembly 1600 includes a motor 1602 fixedly positioned relative to the base 1102 and operably coupled to a controller 1612, which controls the operation of the motor according to various operator inputs and operating conditions. A power supply 1610 provides power to drive the motor. The motor 1602 has an output shaft 1604 that is coupled to a drive shaft 1606 by a known transmission 1608. The drive shaft 1606 is rotatably mounted about an axis 1902 so that the motor selectively rotates the drive shaft about axis 1902. The drive shaft 1606 extends across the width of the operable ramp 1100 and is coupled at each end to a drive linkage 1650. In the illustrated embodiment, the drive linkages 1650 are similar. Accordingly, one drive linkage 1650 will be described with the understanding that the other drive linkage is likewise configured.

Drive Linkage

Figure 29:
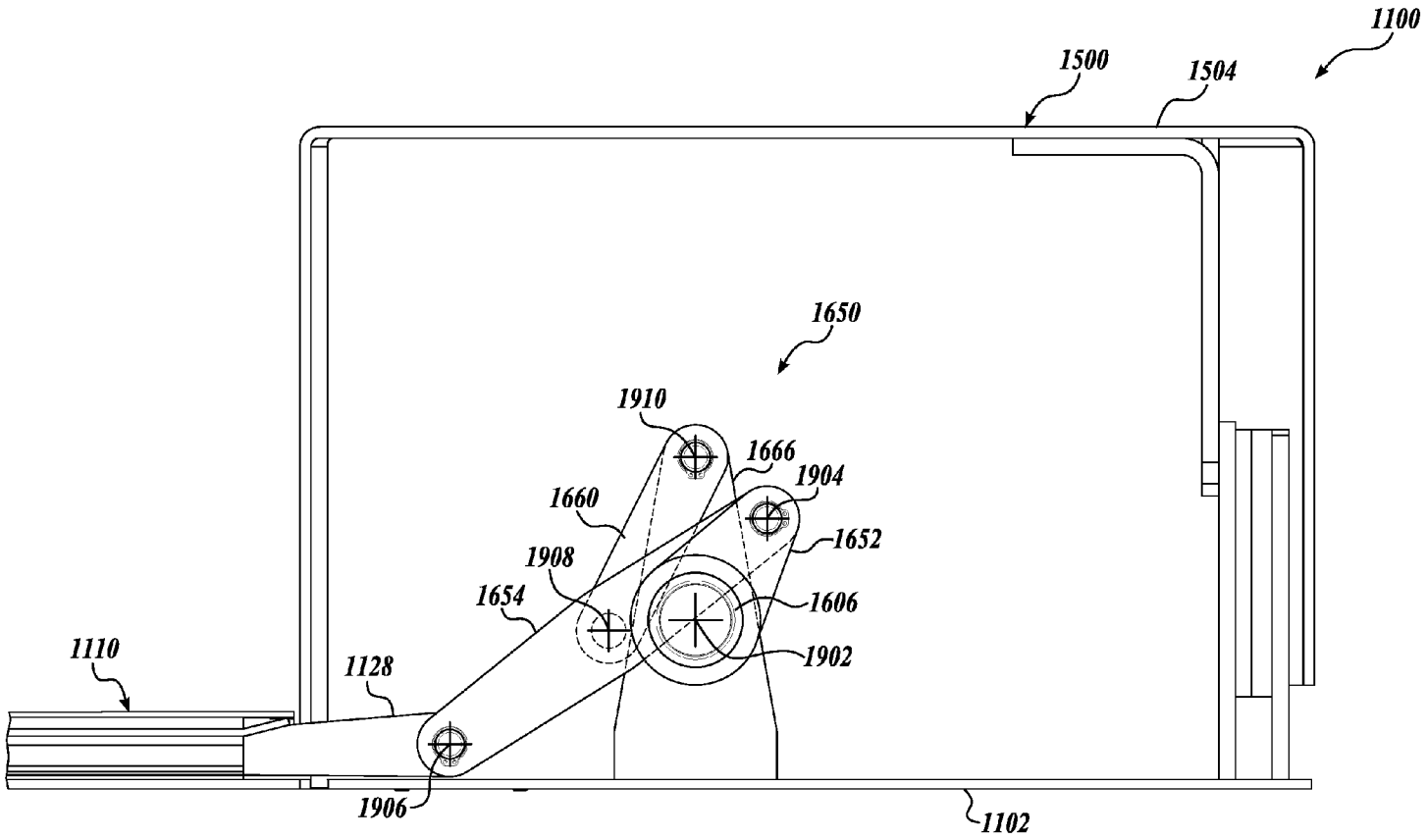
FIG. 29 shows a partial cutaway side view of the drive assembly of FIG. 26 with the operable ramp in the stowed position and the operable ramp configured for a first step height.
Figure 30:
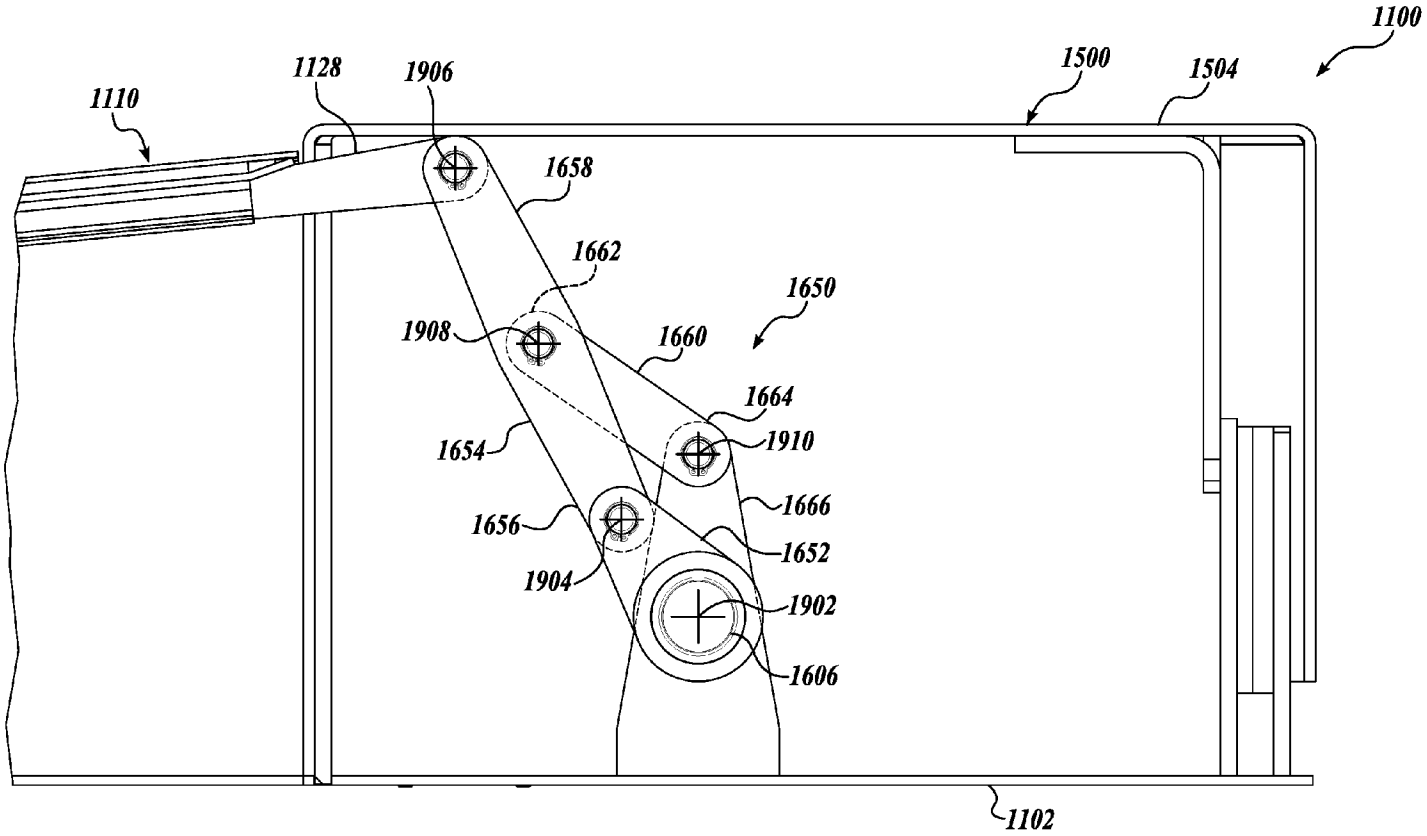
FIG. 30 shows a partial cutaway side view of the drive assembly of FIG. 29 with the operable ramp in the deployed position and the operable ramp configured for the first step height.

Referring now to FIGS. 29 and 30, a side view of one drive linkage 1650 is shown with the operable ramp in the stowed position (FIG. 29) and a deployed position (FIG. 30). The drive linkage 1650 includes a drive arm 1652 fixedly mounted to the drive shaft 1606 so that selective rotation of the drive shaft by the motor 1602 rotates the drive arm about axis 1902. An elongate drive link 1654 is rotatably coupled at a first end 1656 to the drive arm 1652 about axis 1904, which is parallel to axis 1902. A second end 1658 of the drive link 1654 is rotatably coupled to a support element 1128, which extends from the first end 1112 of the first ramp panel 1110, about an axis 1906 that is parallel to axes 1902 and 1904.

A first end 1662 of an elongate control link 1660 is rotatably coupled about an axis 1908 to the drive link 1654 so that axis 1908 is positioned between axis 1904 and axis 1906. A second end 1664 of the control link 1660 is rotatably coupled about an axis 1910 to a control link support 1666. The control link support 1666 is fixedly positioned relative to the base 1102 of the operable ramp 1100, and therefore axis 1910 is also fixedly secured relative to the base of the operable ramp.

The drive arm 1652, the drive link 1654, the control link 1660, and the control link support 1666 (or more specifically, the structure that maintains the fixed relationship between axes 1902 and 1910) cooperate to form a four-bar linkage (the drive linkage 1650) with joints at axes 1902, 1904, 1908, and 1910. The drive linkage components are sized and configured so that rotation of the drive arm 1652 about axis 1902 drives the axis 1906 along a generally vertical path as the operable ramp 1100 reciprocates between the stowed and deployed positions.

It will be appreciated that the path of axis 1906 need not be a perfectly straight vertical line within the scope of the present disclosure. Instead, as used herein, the movement of axis 1906 along "a generally vertical path" is considered to be achieved when a gap between the first end 1112 of the first ramp panel 1110 and the housing 1500 does not exceed a predetermined value as the operable ramp 1100 reciprocates between the stowed and deployed positions, and more specifically, in all of the possible step height configurations. In one embodiment, the gap between the first end 1112 of the first ramp panel 1110 and the housing 1500 does not exceed ½ inch as the operable ramp 1100 reciprocates between the stowed and deployed positions. It will be appreciated that the maximum gap resulting from axis 1906 moving along "a generally vertical path" can vary, and such variations should be considered within the scope of the present disclosure.

Figure 31:
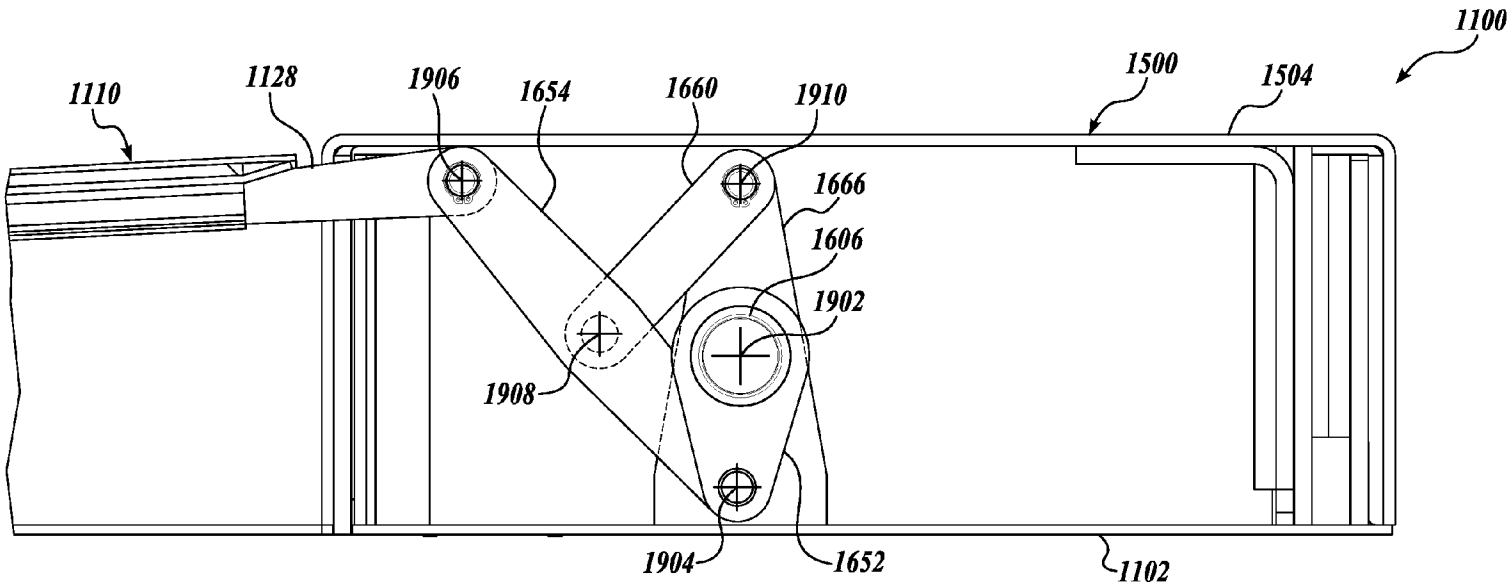
FIG. 31 shows a partial cutaway side view of the drive assembly of FIG. 29 with the operable ramp in the deployed position and the operable ramp configured for a second step height.

FIGS. 29 and 30 show the operable ramp 1100 in stowed and deployed positions, respectively, when the operable ramp is configured for installation in conjunction with a step having a taller riser, for example, a 7 inch riser. FIG. 31 shows the operable ramp 1100 configured for installation in conjunction with a shorter step, for example, a step with a 4 inch riser. Because the gap between the first end 1112 of the first ramp panel 1110 and the housing 1500 does not exceed a predetermined gap as the operable ramp 1100 reciprocates between the stowed and deployed positions, the drive linkage 1650 can be configured for different step heights by simply controlling the vertical distance traveled by the second end 1658 of the drive link 1654, and, therefore, the first end 1112 of the first panel 1110. Regardless of the height of the first end 1112 of the first panel 1110 at maximum elevation, i.e., in the deployed position, the gap between the first end 1112 of the first panel 1110 and the housing 1500 will not exceed an acceptable value.

Position Sensors

Referring back to FIGS. 27 and 28, the operable ramp 1100 includes position sensors that sense the position of the operable ramp 1100 by sensing the position of the drive shaft 1606. An upper limit sensor 1820 is configured to detect a target 1826 when the target is in a predetermined position relative to the sensor.

The sensor 1820 is mounted to a sensor mount 1822, which is fixedly secured relative to the base 1102 of the operable ramp 1100. The position of the sensor 1820 is selectively adjustable along an arcuate slot 1824 formed in the sensor mount 1822, wherein the arcuate slot extends part of the way around the axis 1902 of the drive shaft 1606.

The target 1826 is coupled to the drive shaft 1606 proximate to the sensor so that the target travels along an arcuate path as the drive shaft 1606 rotates. The drive linkage 1650 is configured so each possible position of the operable ramp 1100, i.e., each elevation of the first end 1112 of the first panel 1110, corresponds to a particular position of the drive shaft 1606. When the operable ramp 1100 moves toward the deployed position, the drive shaft 1606 rotates, and the target 1826 moves along an arcuate path toward the sensor. The sensor 1820 is positioned to detect the target 1826 when the operable ramp has deployed to a height corresponding to the riser height of a particular installation. When the sensor 1820 detects the target 1826, the operable ramp is in the deployed position, and the sensor sends a signal to the controller 1612. In response to receiving the signal from the sensor 1820, the controller stops the motor from rotating the drive shaft 1606, and further deployment of the operable ramp 1100 is prevented. That is, the operable ramp 1100 deploys until the upper limit sensor 1820 senses the target 1826 and signals to the controller 1612 that the operable ramp is in the deployed position.

Because the sensor 1820 position can be adjusted, the operable ramp 1100 position at which the deployment motion ends can also be adjusted. Accordingly, the operable ramp deployment can be selectively configured so that the first end 1112 of the first panel 1110 is positioned proximate to the upper surface 1504 of the housing 1500, which is itself determined by the architectural environment in which the operable ramp 1100 is installed.

Still referring to FIGS. 27 and 28, a lower limit sensor 1830 is fixedly positioned relative to the base 1102 of the operable ramp 1100, proximate to the drive shaft 1606. A corresponding target 1832 is mounted to the drive shaft 1606 and is positioned so that the target is detected when the operable ramp 1100 is in the stowed position. As the operable ramp travels from the deployed position to the stowed position, the target 1832 moves in an arcuate path toward the sensor 1830. When the target 1832 reaches a particular position relative to the sensor 1830, i.e., a position corresponding to the operable ramp 1100 being in the stowed position, the sensor detects the target and sends a signal to the controller 1612, which stops the motor 1602, thereby ending the stowing motion.

Counterbalance

In order to reduce the size of the actuating force required from the motor 1602 and to reduce wear and tear on the drive assembly 1600 components in general, the operable ramp 1100 includes a counterbalance 1300 disposed within the housing 1500 and extending under the first ramp panel 1110. In the illustrated embodiment, shown in FIGS. 27 and 28, the counterbalance 1300 is similar in form and function to the previously described counterbalance 300 shown in FIGS. 11, 15, and 16. For the sake of brevity, the counterbalance will not be described again, and reference can be made to the previously described counterbalance 300.

Ratchet Assembly

When the operable ramp 1100 is in a deployed position or moving toward a deployed position, the support structure, which includes the drive assembly 1600, the drive linkage 1650, and the counterbalance 1300, cooperate to support the first panel 1110 and also any people or objects on the first panel. When the operable ramp 1100 is in the deployed position, it is particularly important to maintain the position of the first panel 1110 to prevent a sudden drop because a user might be on the ramp. Absent some additional support structure, such drops could occur due to a power outage or a failure of one or more components of the drive assembly or, in particular, the drive linkage. To prevent such sudden drops, and to decrease wear and tear on the drive assembly components, the operable ramp 1100 includes a ratchet assembly 1700 that supports the first panel 1110 when the operable ramp is in a deployed position.

Figure 32:
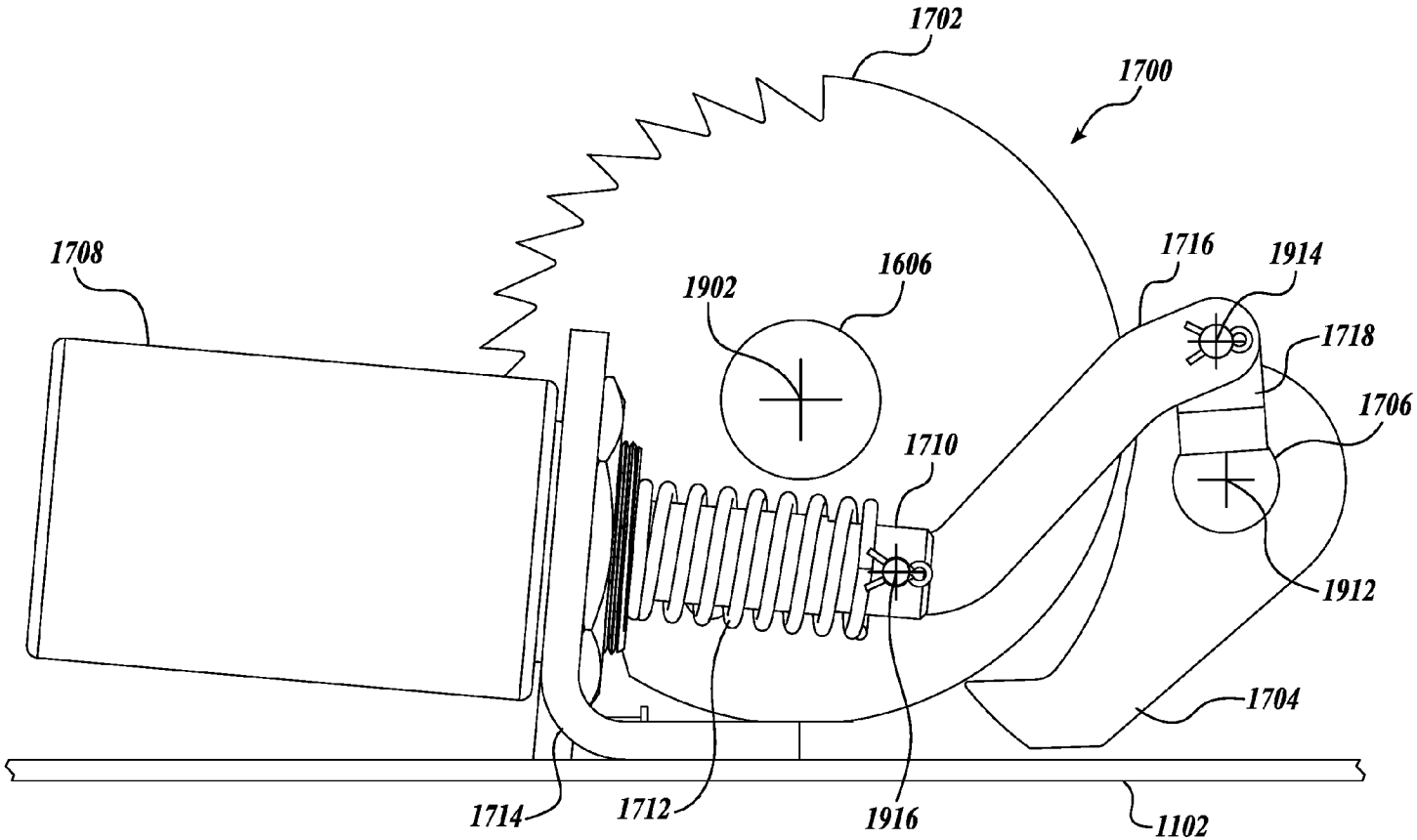
FIG. 32 shows a side view of a ratchet assembly of the operable ramp of FIG. 27 with the operable ramp in the stowed position.
Figure 33:
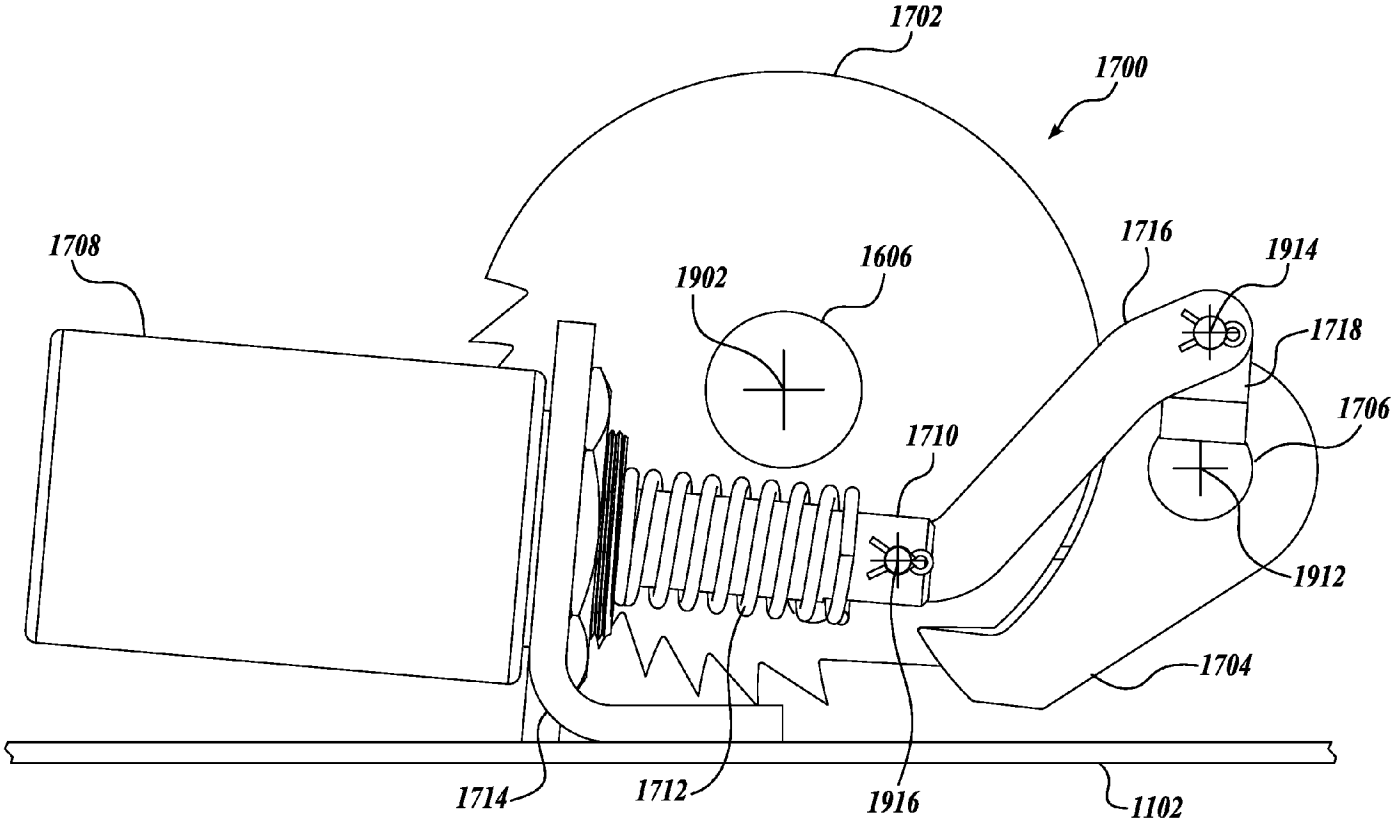
FIG. 33 shows a side view of the ratchet assembly of FIG. 32 with the operable ramp in the deployed position.

Referring now to FIGS. 27, 32 and 33, the ratchet assembly 1700 is positioned within the housing 1500 of the operable ramp 1100. As best shown in FIGS. 32 and 33, the ratchet assembly 1700 includes a ratchet 1702 coupled to the drive shaft 1606 so that rotation of the drive shaft rotates the ratchet about axis 1902. Because the position of the operable ramp 1100, and in particularly the first panel 1110, is determined by the rotational position of the drive shaft 1606, each operable ramp (and first panel) position results in a corresponding ratchet 1702 position. In the illustrated embodiment, the surface of the ratchet 1702 includes a toothed portion and a smooth portion.

A pawl 1704 is fixedly secured to a pawl rod 1706 that is mounted for rotational movement about an axis 1912. Axis 1912 is itself fixedly positioned relative to the base 1102 of the operable ramp 1100 and also parallel to the axis 1902 of the drive shaft 1606. The pawl 1704 engages the surface of the ratchet 1702 such that the ratchet is free to rotate in a clockwise direction (as viewed in FIGS. 32 and 33) regardless of whether the pawl is engaging the toothed portion or smooth portion of the ratchet. In contrast, when the pawl 1704 engages the toothed portion of the ratchet 1702, the pawl prevents counterclockwise rotation of the ratchet. Under these conditions, because the ratchet is prevented from rotating in the counterclockwise direction, the drive shaft 1606 is also prevented from rotating in the counterclockwise direction. The ratchet assembly 1700 is configured such that the pawl 1704 engages a toothed portion of the ratchet 1702 when the operable ramp 1100 is in a deployed position, regardless of the height of the deployed operable ramp.

Referring back to FIGS. 30 and 31, when the operable ramp 1100 is in the deployed position, the weight of the ramp acts through the drive link 1654 in a manner that tends to rotate the drive arm 1652 and the drive shaft 1606 in a counterclockwise direction about axis 1902. The drive linkage 1650 is configured so that this is true regardless of the height of the upper surface 1504 of the housing 1500 and the first end 1112 of the deployed first ramp panel 1110. Consequently, by preventing rotation of the drive shaft 1606 in a counterclockwise direction, the ratchet assembly 1700 prevents the operable ramp 1100 from unexpectedly moving toward the stowed position, i.e., dropping, when a user is on the ramp, or in the event of a power outage or component failure.

A linear actuator 1708 having a selectively extendable piston rod 1710 is fixedly mounted to the base 1102 by an actuator mount 1714. The linear actuator includes a spring 1712 disposed around the piston rod 1710. The spring biases the piston rod 1710 toward an extended position so that the piston rod remains extended until the actuator 1708 is selectively controlled to retract the piston rod.

One end of an elongate link 1716 is rotatably coupled about an axis 1916 of the piston rod 1710. A second end of the elongate link 1716 is rotatably coupled about an axis 1914 to a fitting 1718 that is itself fixedly secured to the pawl rod 1706. The elongate link 1716 is configured so that when the piston rod 1710 of the actuator 1708 is extended, the pawl 1704 engages the surface of the ratchet 1702. When the piston rod 1710 of the actuator 1708 is retracted, the elongate link 1716 rotates the pawl 1704 about axis 1912 to disengage the pawl from the surface of the ratchet. With the pawl 1704 disengaged from the ratchet 1702, the drive shaft 1606 is free to rotate in a counterclockwise direction, and the operable ramp can move toward the stowed position.

It will be appreciated that various embodiments of a ratchet assembly are possible. In one alternate embodiment, the ratchet assembly utilizes a rotary actuator or any other suitable configuration to selectively disengage the pawl from the toothed portion of the ratchet. In other alternative embodiments, the size, number, and position of the toothed portion of the ratchet is varied to accommodate different operable ramp assembly configurations and installation heights. These and other variations of the disclosed ratchet assembly are contemplated and should be considered within the scope of the present disclosure.

Closeout Assemblies

As best shown in FIGS. 21, 22, 25, and 26, side closeouts 1800 are positioned along the lateral edges 1116 of the first ramp panel 1110. When the operable ramp 1100 is in the stowed position, the side closeouts 1800 lie generally flat. As the operable ramp 1100 moves to the deployed position, the side closeouts 1800 move to a position in which the closeouts extend downward from the lateral edges 1116 of the first ramp panel 1110 to block the area under the first ramp panel 1110 when in the deployed position, thereby improving safety by minimizing the risk of a "pinch" type injury, and to minimize the intrusion of dirt and debris under the first ramp panel.

Each side closeout 1800 includes an upper hinge plate 1802 hingedly coupled to a lower hinge plate 1804 about an axis 1900. The upper hinge plate 1802 is coupled to a lateral edge 1116 of the first ramp panel 1110, and the lower hinge plate 1804 extends downward from axis 1900 to contact the base 1102 of the operable ramp 1100. In the illustrated embodiment, a stiffener 1806 is coupled to a lower side of the lower hinge plate 1804 to increase the strength and durability of the side closeout 1800. A pin 1808 extends from an outer edge of the lower hinge plate 1804, through a horizontal slot 1516 formed in the housing 1500 (see FIGS. 21 and 22) and into a guide 1810 positioned within the housing (see FIG. 27).

When the operable ramp 1100 is in the stowed position, the side closeouts 1800 lie essentially flat along the first ramp panel 1110 and the base 1102. As the operable ramp 1100 moves to the deployed position, the first end 1112 of the first ramp panel 1110 moves upward, which also moves axis 1900 upward. At the same time, the pin 1808 moves along the guide 1810. The movement of axis 1900 with the first ramp panel 1110 and the movement of the pin 1808 within the guide 1810 raises the upper hinge plate 1802 and also rotates the lower hinge plate 1804 about axis 1900 such that the lower hinge plate extends downward from axis 1900. Engagement of the pin 1808 with the guide 1810 prevents the outer/lower edge of the lower hinge plate 1804 from disengaging from the base 1102. That is the pin 1808 prevents the lower hinge plate 1804 from rotating upward about axis 1900 in a manner that would expose the area under the first ramp panel 1110.

Ramp Operation

When the operable ramp 1100 is in the stowed position of FIGS. 19, 21, and 29, the operable ramp 1100 integrates with the step 1056 of the architectural environment. The upper surface 1504 of the housing 1500 is generally coplanar with the tread 1058 of the step 1056, and the tread surface 1126 of the first ramp panel 1110 is generally horizontal and parallel to the first surface 1062 of the architectural environment. The second ramp panel 1140 and the base 1102, which extends outwardly from the lateral edges of the first ramp panel 1110, both have inclined surfaces that provide a smooth transition from the tread surface 1126 of the first ramp panel 1110 to the first surface 1062 of the architectural environment. Because of the thin profile of the first ramp panel 1110 and the transitions provided by the base 1102 and second ramp panel 1140, it is not necessary to recess the operable ramp 1100 below the first surface 1062.

Referring now to FIGS. 29 and 30, with the operable ramp 1100 in the stowed position (FIG. 29), the second end 1658 of the drive link 1654 and, therefore, the end of the support element 1128 is in a lowered position so that the first ramp panel 1110 is substantially horizontal. To move the operable ramp 1100 from the stowed position to the deployed position (FIG. 30), the motor 1602 rotates the drive shaft 1606 and, thus, the drive arm 1652 in a clockwise direction as viewed in FIG. 29. As the drive arm 1652 rotates in the clockwise direction, the drive link 1654 raises the end of the support element 1128, which in turn raises the first end 1112 of the first ramp panel 1110. To prevent binding, the second ramp panel 1140 slides relative to the base 1102 to account for any horizontal displacement of the first ramp panel 1110 during the deployment motion. The second ramp panel 1140 also supports the second end 1114 of the first ramp panel 1110. As the drive shaft 1606 rotates in a clockwise direction, the pawl 1704 slidingly engages the surface of the ratchet 1702, first the smooth portion, and then the toothed portion. When the operable ramp 1100 reaches the deployed position, the pawl 1704 is engaged with the toothed portion of the ratchet so that the ratchet assembly 1700 prevents movement of the operable ramp 1100 back toward the stowed position.

In an alternate embodiment, during deployment, the linear actuator disengages the pawl from the surface of the ratchet until the sensor detects the ramp panel is in the deployed position. The sensor then signals the actuator via the controller to engage the pawl with the toothed portion of the ratchet.

To move the operable ramp 1100 from the deployed position to the stowed position, linear actuator 1708 of the ratchet assembly 1700 retracts the piston rod 1710 to disengage the pawl 1704 from the ratchet 1702. With the pawl 1704 disengaged, the motor 1602 rotates the drive arm 1652 in a counterclockwise direction as viewed in FIGS. 30 and 31 so that the drive linkage 1650 lowers the end of the support element 1128 and, therefore, the first ramp panel 1110. When the operable ramp 1100 reaches the stowed position or a point at which the pawl 1704 would not contact the toothed portion of the ratchet 1702, the actuator 1708 extends the piston rod 1710 so that the pawl engages the ratchet.

It will be appreciated that a number of alternate drive assemblies 1600 and drive linkage 1650 configurations can be utilized to selectively raise and lower the support element 1128. These and other configurations that selectively raise and lower the ends of the support element 1128 are contemplated and should be considered within the scope of the present disclosure.

Manual Stow/Deploy

In the event of a loss of power or a motor failure, an operator can actuate the operable ramp 1100 manually. To do so, the operator removes a cover 1510 (FIG. 22) from the closeout 1502 to expose a manual ratchet release 1750 and a keyway 1382. (See FIGS. 26 and 27). To move the operable ramp 1100 from the deployed position to the stowed position, the operator first operates the manual ratchet release 1750 to disengage the pawl 1704 from the ratchet 1702. This step is not necessary to manually move the operable ramp from the stowed position to the deployed position.

Figure 34:
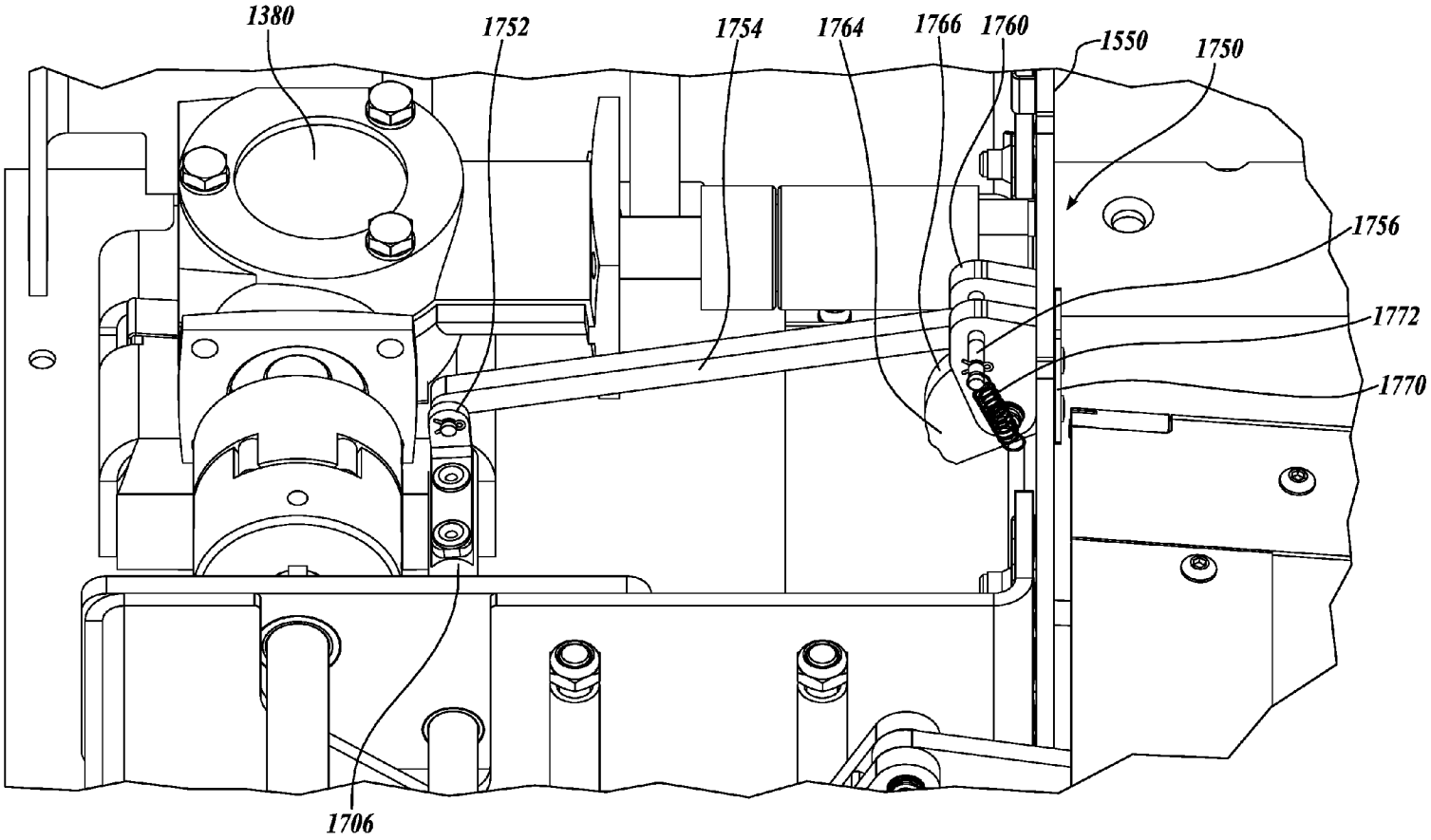
FIG. 34 shows an elevated partial side view of a manual ratchet release of the operable ramp of FIG. 27.
Figure 35:
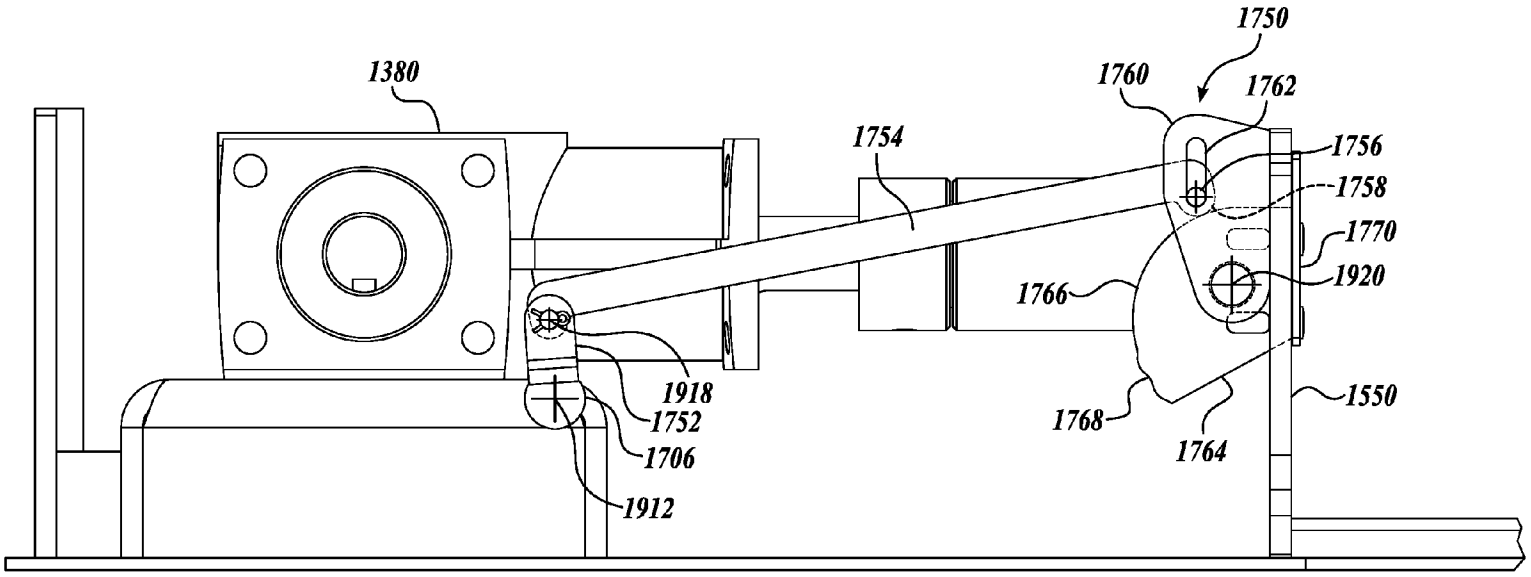
FIG. 35 shows a partial side view of the manual ratchet release of FIG. 34 with a cam in a first position.
Figure 36:
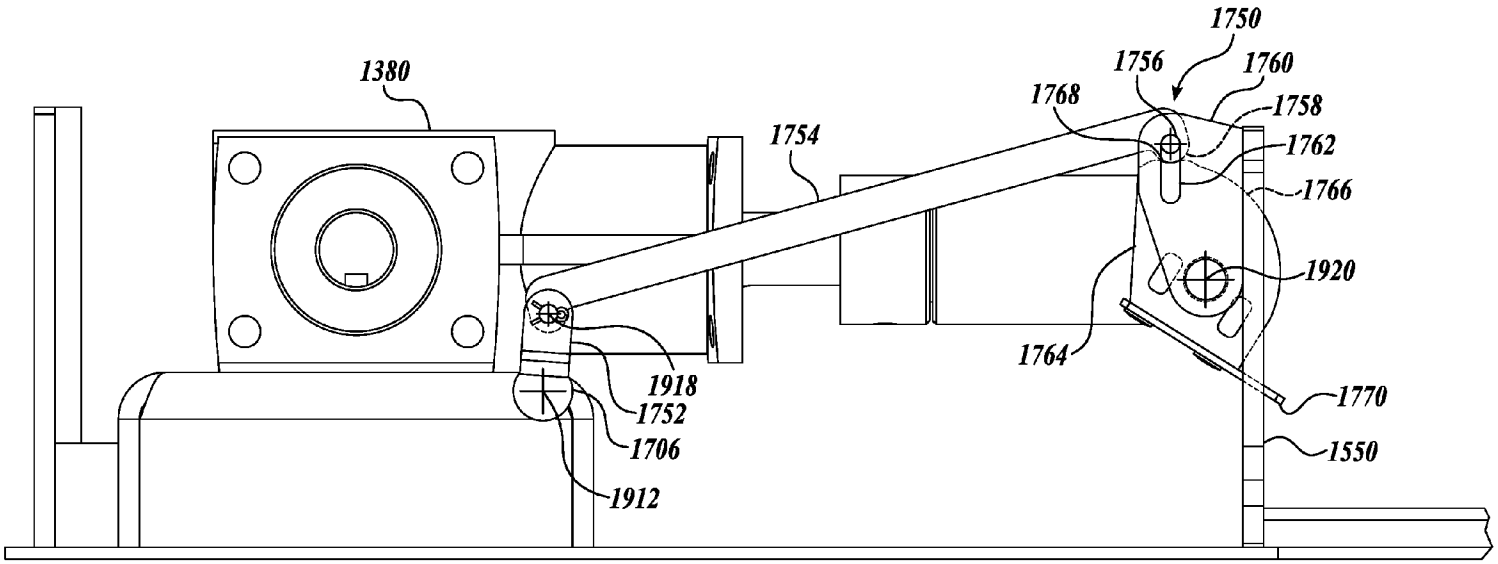
FIG. 36 shows a partial side view of the manual ratchet release of FIG. 34 with the cam in a second position.

Referring to FIGS. 34-36, the manual ratchet release 1750 includes a guide fitting 1760 fixedly secured to the housing base 1550 of the housing 1500. A cam 1764 is rotatably coupled to the guide fitting 1760 about axis 1920 and extends partially through a slot formed in the housing base 1550 so that the cam is rotatable between a first position, shown in FIG. 35, and a second position, shown in FIG. 36. A plate 1770 is coupled to the cam 1764 and acts as a lever that enables an operator to rotate the cam from the first position to the second position.

The guide fitting 1760 includes a pair of vertical slots 1762 formed therein. A pin 1756 extends through and is slidingly retained by the slots 1762. The pin 1756 is coupled to one end of an elongate link 1754 so that the first end of the link is slidably associated with the guide fitting 1760. A bearing surface 1758 is disposed on the end of the link 1754 and is sized and positioned to slidingly engage a cam surface 1766 formed on the cam 1764. As shown in FIG. 34, a spring 1772 extends between the pin 1756 and the guide fitting 1760. The spring 1772 applies a force to the pin 1756 in the direction of the cam surface 1766 so that the pin 1756 maintains sliding contact with the cam surface.

A second end of the link 1754 is rotatably coupled to a pawl rod fitting 1752 about an axis 1918. The pawl rod fitting 1752 is fixedly coupled to the pawl rod 1706 so that rotation of the pawl rod about axis 1912 moves axis 1918 along an arcuate path.

To disengage the ratchet assembly 1700, an operator pulls down on a top portion of plate 1770 to rotate the cam 1764 in a clockwise direction about axis 1920 as viewed in FIGS. 35 and 36. As the cam 1764 rotates between the first position and the second position, the cam surface 1766, which is in sliding engagement with the bearing surface 1758, drives the first end of the link 1754 upward. The path of upward travel of the first end of the link 1754 is controlled by the engagement of the pin 1756 with the slot 1762. As the pin 1756 moves upward in the slot 1762, the link 1754 pulls on the pawl rod fitting 1752, thereby rotating the pawl rod 1706 and disengaging the pawl 1704 from the ratchet.

When the cam 1764 reaches the second position of FIG. 36, the bearing surface 1758 is nested in a recess 1768 formed in the cam surface 1766. The biasing force provided by the spring 1772 is such that the bearing surface 1758 is urged to remain in the recess 1768. That is, the cam 1764 remains in the second position until an operator applies a force to the plate 1770 that is sufficient to overcome the biasing force of the spring and slide the bearing surface out of the recess.

Referring back to FIGS. 27 and 28, a gearbox 1380 is operably coupled to the drive assembly 1600. In the illustrated embodiment, the gearbox 1380 is coupled to the output shaft 1604 of the motor 1602, however, it will be appreciated that the gearbox can be coupled to any component of the drive assembly 1600 that allows the drive assembly to be actuated by the gearbox. The gearbox 1380 includes an input shaft, wherein the previously noted keyway 1382 is disposed on an end of the input shaft.

With the cover 1510 removed, and the ratchet assembly 1700 disengaged (if necessary), the operator inserts a crank onto the keyway 1382 and rotates the crank in a first direction to move the operable ramp 1100 toward the deployed position, and in a second direction to move the operable ramp toward the stowed position.

It will be appreciated that a number of variations to the illustrated manual deploy and stow mechanism can be incorporated. In this respect, the size, position, and configurations of mechanisms that transfer a manual input into the drive assembly 1600 can vary, and such variations should be considered within the scope of the present disclosure.

While illustrative embodiments have been illustrated and described, it will be appreciated that various changes can be made therein without departing from the spirit and scope of the invention.

The embodiments of the invention in which an exclusive property or privilege is claimed are defined as follows:

1. An operable ramp moveable between a stowed position and a deployed position, the deployed position providing a sloped transition surface that extends from a lower surface of an architectural setting to an upper surface of the architectural setting, the operable ramp comprising:

(a) a ramp panel;

(b) a housing having an upper surface, the housing being configured to provide selective adjustment to a height of the upper surface of the housing; and (c) a drive assembly at least partially disposed within the housing, the drive assembly comprising a drive linkage coupled to a first end of the ramp panel to reciprocate the operable ramp between the stowed position and the deployed position, the drive linkage being configured to raise the first end of the ramp panel to a first elevation when the upper surface of the housing is at a first height and to a second elevation when the upper surface of the housing is at a second height.

2. The operable ramp of claim 1, the housing comprising a base portion, wherein the position of the upper surface of the housing relative to the base portion is selectively adjustable.

3. The operable ramp of claim 2, the drive linkage comprising a drive arm rotatably coupled about a first axis, the first axis being fixedly positioned relative to the base portion of the housing.

4. The operable ramp of claim 3, the drive linkage further comprising a drive link rotatably coupled at a first end to the drive arm and rotatably coupled at a second end to the ramp panel.

5. The operable ramp of claim 4, the drive linkage further comprising a control link configured to rotate about a second axis that has a fixed position relative to the base portion, the control link being rotatably coupled to the drive link about a third axis.

6. The operable ramp of claim 5, wherein the third axis is located between the first and the second end of the drive link.

7. The operable ramp of claim 2, further comprising a controller and a sensor, the sensor being configured to sense a predetermined position of the ramp panel and to send a signal to the controller when the ramp panel is in the predetermined position.

8. The operable ramp of claim 7, wherein the sensor is selectively adjustable to sense one of a plurality of predetermined ramp panel positions.

9. The operable ramp of claim 8, wherein each of the plurality of predetermined positions defines a different deployed position, each of the different deployed positions corresponding to a different height of the upper surface.

10. The operable ramp of claim 8, the sensor being adjustably mounted to the operable ramp, wherein the position of the sensor determines which of the plurality of predetermined ramp panel positions is sensed.

11. The operable ramp of claim 1, the drive assembly further comprising a selectively rotatable drive shaft operatively coupled to the drive linkage, rotation of the drive shaft in a first direction driving the first end of the ramp panel toward the deployed position, rotation of the drive shaft in a second direction driving the first end of the ramp panel toward the stowed position.

12. An operable ramp moveable between a stowed position and a deployed position, the deployed position providing a sloped transition surface that extends from a lower surface of an architectural setting to an upper surface of the architectural setting, the operable ramp comprising:

(a) a ramp panel;

(b) a housing having an upper surface and a base, the position of the upper surface of the housing relative to the base being selectively adjustable; and (c) a drive assembly at least partially disposed within the housing, the drive assembly comprising a four-bar linkage operatively coupled to the ramp panel, the four bar linkage being selectively actuated to reciprocate the ramp panel between a stowed position and a deployed position.

13. The operable ramp of claim 12, further comprising a sensor to sense a predetermined ramp panel position and a controller programmed to stop a deployment motion when the ramp panel reaches the predetermined ramp panel position.

14. The operable ramp of claim 13, wherein the sensor is selectively positionable to change the predetermined ramp panel position to correspond to a particular upper surface position.

15. The operable ramp of claim 12, the drive assembly further comprising a selectively rotatable drive shaft operatively coupled to the four-bar linkage, rotation of the drive shaft in a first direction driving the four-bar linkage to move the first panel toward the deployed position, rotation of the drive shaft in a second direction driving the four-bar linkage to move the first panel toward the stowed position.

16. The operable ramp of claim 15, the drive assembly further comprising:

(a) a ratchet configured to rotate in a first direction when the ramp moves toward the stowed position; and (b) a pawl selectively engaging the ratchet, the pawl engaging the ratchet when the operable ramp is in the deployed position to prevent the operable ramp from moving toward the stowed position.

17. The operable ramp of claim 16, wherein the pawl selectively disengages the ratchet to allow the operable ramp to move from the deployed position toward the stowed position.

18. The operable ramp of claim 12, the four-bar linkage defining four axes, wherein two of the four axes are fixedly positioned relative to the base.

19. The operable ramp of claim 18, wherein the four-bar linkage comprises a drive arm and a drive link, each of the drive arm and the drive link defining one of the links of the four-bar linkage, the drive arm being rotatable about a first of the four axis, the first axis being fixedly positioned relative to the base, the drive arm being rotatably coupled to the drive link about a second of the four axes, the drive link being rotatably coupled to the ramp panel about a fifth axis.

20. The operable ramp of claim 19, wherein the four-bar linkage further comprises a control link operably coupled to the drive link about a third of the four axes, wherein the third axis is disposed between the second axis and the fifth axis.

* * * * *